US009309578B2

(12) United States Patent
Murao et al.

(10) Patent No.: US 9,309,578 B2
(45) Date of Patent: Apr. 12, 2016

(54) BLAST FURNACE OPERATING METHOD AND TUBE BUNDLE-TYPE LANCE

(71) Applicant: JFE STEEL CORPORATION, Tokyo (JP)

(72) Inventors: Akinori Murao, Fukuyama (JP); Daiki Fujiwara, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/412,340

(22) PCT Filed: Jul. 11, 2013

(86) PCT No.: PCT/JP2013/068945

§ 371 (c)(1),
(2) Date: Dec. 31, 2014

(87) PCT Pub. No.: WO2014/010660

PCT Pub. Date: Jan. 16, 2014

(65) Prior Publication Data

US 2015/0184263 A1 Jul. 2, 2015

(30) Foreign Application Priority Data

Jul. 13, 2012 (JP) ..... 2012-157909
Jul. 13, 2012 (JP) ..... 2012-157910
Jul. 13, 2012 (JP) ..... 2012-157911

(51) Int. Cl.
*C21B 7/00* (2006.01)
*C21B 5/00* (2006.01)
(Continued)

(52) U.S. Cl.
CPC ..... *C21B 5/003* (2013.01); *C21B 7/163* (2013.01); *F27D 3/18* (2013.01)

(58) Field of Classification Search
CPC ..... C21B 7/163; C21B 5/003
USPC ..... 266/268
See application file for complete search history.

(56) References Cited

U.S. PATENT DOCUMENTS 4,243,211 A * 1/1981 Leroy ..... C21C 5/48 266/268
2011/0101576 A1* 5/2011 Cho ..... C21B 7/163 266/47

FOREIGN PATENT DOCUMENTS

CN 101910419 A 12/2010
JP H03-38344 U 4/1991
(Continued)

OTHER PUBLICATIONS

Jul. 22, 2015 Search Report issued in European Application No. 13817445.3.
(Continued)

*Primary Examiner* — Scott Kastler
(74) *Attorney, Agent, or Firm* — Oliff PLC

(57) ABSTRACT

A blast furnace operating method by blowing at least a solid reducing material into an inside of the furnace from a tuyere thereof with a lance, wherein a tube bundle-type lance formed by bundling a plurality of blowing tubes side-by-side and housing them in a main tube of the lance is used when only a solid reducing material or two kinds of a solid reducing material and a combustible gas or three kinds of a solid reducing material, a combustible gas and a gaseous reducing material are blown in the inside of the blast furnace, whereby the solid reducing material, combustible gas and gaseous reducing material are blown through the respective blowing tubes, and a tube bundle-type lance.

19 Claims, 20 Drawing Sheets

(51) Int. Cl.
*C21B 7/16* (2006.01)
*F27D 3/18* (2006.01)

(56) References Cited

FOREIGN PATENT DOCUMENTS

| | | | |
|---|---|---|---|
| JP | H11-12613 | A | 1/1999 |
| JP | 2001-200308 | A | 7/2001 |
| JP | 2004-183104 | A | 7/2004 |
| JP | 2007-162038 | A | 6/2007 |
| JP | 2010-537153 | A | 12/2010 |
| JP | 2011-174171 | A | 9/2011 |
| WO | 2009/082122 | A2 | 7/2009 |
| WO | 2011/108960 | A1 | 9/2011 |

OTHER PUBLICATIONS

Jan. 13, 2015 International Preliminary Report on Patentability issued in International Application No. PCT/JP2013/068945.
Aug. 6, 2013 Written Opinion issued in International Application No. PCT/JP2013/068945.
Nov. 12, 2015 Office Action issued in Chinese Application No. 201380036821.4.

* cited by examiner

| | Nominal diameter | Nominal thickness | Outer diameter mm | Inner diameter mm | Gauge mm |
|---|---|---|---|---|---|
| Outer tube | 20A | Schedule 10S | 27.20 | 23.00 | 2.1 |
| Middle tube | 15A | Schedule 40 | 21.70 | 16.10 | 2.8 |
| Inner tube | 8A | Schedule 10S | 13.80 | 10.50 | 1.65 |

| | Nominal diameter | Nominal thickness | Outer diameter mm | Inner diameter mm | Gauge mm |
|---|---|---|---|---|---|
| First tube 21 | 8A | Schedule 5S | 13.80 | 10.50 | 1.65 |
| Second tube 22 | 6A | Schedule 10S | 10.50 | 8.10 | 1.20 |
| Third tube 23 | 6A | Schedule 20S | 10.50 | 7.50 | 1.50 |

(a)

(b)

(c)

BLAST FURNACE OPERATING METHOD AND TUBE BUNDLE-TYPE LANCE

TECHNICAL FIELD

This invention relates to a method of operating a blast furnace, which is effective to attain the improvement of productivity and the decrease of consumption rate of reducing material by blowing a solid reducing material such as pulverized coal or the like or a gaseous reducing material such as LNG (Liquefied Natural Gas) or the like together with a combustible gas into an inside of a blast furnace through tuyeres thereof to increase combustion temperature, and a tube bundle-type lance used in the operation of this method.

RELATED ART

Recently, global warming due to the increase of discharge amount of carbon dioxide, which is a significant issue in the steel industry. As to this issue, operation of low reduction agent ratio (Reduction Agent Ratio, sum of amount of reduction agent blown from tuyeres and amount of coke charged from furnace top per 1 ton of pig iron) is promoted in latest blast furnaces. In the blast furnace are mainly used coke and pulverized coal as a reducing material. In order to achieve the operation of low reduction agent ratio and hence the suppression of the discharge amount of carbon dioxide, therefore, it is effective to take a method of replacing coke or the like with a reducing material having a high hydrogen content such as waste plastic, LNG, heavy oil or the like.

Patent Document 1 discloses a method wherein plural lances are used and a solid reducing material, a gaseous reducing material and a combustible gas are blown from the respective lances to promote temperature rising of the solid reducing material and improve combustion efficiency and further suppress the generation of unburned powder or coke powder to improve air permeability to thereby reduce the reduction agent ratio. Also, Patent Document 2 discloses a technique wherein a lance is a coaxially multiple tube type and a combustible gas is blown from an inner tube and a gaseous reducing material and a solid reducing material are blown from a gap between inner tube and outer tube. Furthermore, Patent Document 3 proposes a lance wherein a plurality of small-size tubes are arranged side-by side around an outer periphery of a main lance tube. In addition, Patent Document 4 discloses a multiple tubed nozzle wherein a plurality of blowing tubes are arranged in parallel at given intervals outside a fuel feed tube when a combustible gas and a fuel are blown into a melting/reducing furnace in such a manner that a mixed state of the combustible gas and the fuel can be always maintained even if one of the blowing tubes is damaged.

PRIOR ART DOCUMENTS

Patent Documents

Patent Document 1: JP-A-2007-162038
Patent Document 2: JP-A-2011-174171
Patent Document 3: JP-A-H11-12613
Patent Document 4: JU-A-H03-38344

SUMMARY OF THE INVENTION

Task to be Solved by the Invention

The blast furnace operating method disclosed in Patent Document 1 has effects in the increase of combustion temperature and the decrease of consumption rate of reducing material as compared to a method of blowing only the solid reducing material (pulverized coal) from tuyeres because the gaseous reducing material is also blown, but the effects are insufficient only in the adjustment of blowing positions. Also, the multiple tubed lance disclosed in Patent Document 2 requires the cooling of the lance, so that the outer blowing rate should be made faster. To this end, the gap between the inner tube and the outer ring tube should be made narrower and hence a given amount of the gas cannot be flown and there is a fear that the required combustibility is not obtained. If it is intended to establish the gas amount and the flow rate, the diameter of the lance should be made larger, which brings about the decrease of blast volume from a blow pipe. As a result, a risk of breaking the surrounding refractories is increased in association with the decrease of amount of molten iron tapped or the increase of plug-in diameter for the lance.

In the technique disclosed in Patent Document 3 is used a lance formed by arranging the plural small-size tubes around the main tube, so that there are problems that not only a risk of clogging the small-size tubes due to the decrease of the cooling ability is enhanced but also the process cost of a lance becomes higher. Also, this technique has a problem that pressure loss and the diameter become larger because the multiple tubes are changed into parallel tubes on the way.

As previously mentioned, hot air is fed to the blast furnace through the tuyeres, but the solid reducing material and combustible gas are also blown into the inside of the furnace with the hot air. In the lance disclosed in Patent Document 4, the solid reducing material and the combustible gas are blown with the coaxially double-tubed lance, but a single tube lance for blowing the gaseous reducing material is further arranged side-by-side to the double-tubed lance. The latter lance is large in the occupying area with respect to sectional areas of blast pipe and tuyere, which brings about the increase of running cost due to the increase of blast pressure or the decrease of visual field in a window for monitoring of the furnace arranged in a back face of the tuyere. Also, since the size of a portion for inserting the lance into a blow pipe (guide pipe) is increased, there is a problem that an adhesion face of the guide pipe portion to the blow pipe is decreased to easily cause peel-off of the guide pipe portion.

It is, therefore, an object of the invention to provide a blast furnace operating method, which simultaneously establishes the improvement of cooling ability and the improvement of combustibility without increasing the outer diameter of the lance and is effective for the reduction of consumption rate of reducing material, and a tube bundle-type lance used in the operation of this method.

Solution for Task

In order to solve the above task, the invention lines in a method of operating a blast furnace by blowing at least a solid reducing material into an inside of the furnace from a tuyere thereof with a lance, characterized in that a tube bundle-type lance formed by bundling a plurality of blowing tubes side-by-side and housing them in a main tube of the lance is used when only a solid reducing material or two kinds of a solid reducing material and a combustible gas or three kinds of a solid reducing material, a combustible gas and a gaseous reducing material are blown in the inside of the blast furnace, whereby the solid reducing material, combustible gas and gaseous reducing material are blown through the respective blowing tubes.

In the blast furnace operating method according to the invention, it is a more preferable means that (1) the solid reducing material is either a high volatile matter pulverized coal or a low volatile matter pulverized coal or both;

(2) the combustible gas is oxygen or oxygen-enriched air;

(3) the gaseous reducing material is any of LNG, urban gas, propane gas, gas generated from a hydrogen producing factory and shale gas;

(4) a front end of the blowing tube for the high volatile matter pulverized coal is located at a distance of 0~100 mm at an upstream side from a front end of the blowing tube for the low volatile matter pulverized coal when the high volatile matter pulverized coal and the low volatile matter pulverized coal are blown as the solid reducing material;

(5) a front end of the blowing tube for the high volatile matter pulverized coal is located at a distance of 0~200 mm at an upstream side from a front end of the blowing tube for the low volatile matter pulverized coal when the high volatile matter pulverized coal, the low volatile matter pulverized coal and oxygen are blown simultaneously;

(6) a front end of the blowing tube for the gaseous reducing material is located at a distance of 1~100 mm at an upstream side from a front end of the blowing tube for the solid reducing material with the tube bundle-type lance when the gaseous reducing material and the solid reducing material are blown simultaneously;

(7) a front end of the blowing tube for the gaseous reducing material is located at a distance of 1~200 mm at an upstream side from a front end of the blowing tube for the solid reducing material with the tube bundle-type lance when the gaseous reducing material, the solid reducing material and oxygen are blown simultaneously;

(8) a tube bundle-type lance formed by winding another blowing tubes around the blowing tube for the solid reducing material and integrally uniting them is used when the solid reducing material, the combustible gas and the gaseous reducing material are blown simultaneously.

Further, the invention proposes a tube bundle-type lance for blowing at least one of a solid reducing material, a combustible gas and a gaseous reducing material into an inside of a blast furnace through tuyeres thereof, characterized in that a plurality of blowing tubes are bundled at a side-by-side state and housed in a main tube for lance.

In the tube bundle-type lance according to the invention, it is a more preferable means that (1) the solid reducing material is either a high volatile matter pulverized coal or a low volatile matter pulverized coal or both;

(2) the combustible gas is oxygen or oxygen-enriched air;

(3) the gaseous reducing material is any of LNG, urban gas, propane gas, gas generated from a hydrogen producing factory and shale gas;

(4) a front end of the blowing tube for the high volatile matter pulverized coal is located at a distance of 0~100 mm in an upstream side from a front end of the blowing tube for the low volatile matter pulverized coal in the lance blowing the high volatile matter pulverized coal and the low volatile matter pulverized coal as the solid reducing material;

(5) a front end of the blowing tube for the high volatile matter pulverized coal is located at a distance of 0~200 mm in an upstream side from a front end of the blowing tube for the low volatile matter pulverized coal in the lance simultaneously blowing the high volatile matter pulverized coal, the low volatile matter pulverized coal and oxygen as the solid reducing material;

(6) a front end of the blowing tube for the gaseous reducing material is located at a distance of 0~100 mm in an upstream side from a front end of the blowing tube for the solid reducing material in the lance simultaneously blowing the gaseous reducing material and the solid reducing material;

(7) a front end of the blowing tube for the gaseous reducing material is located at a distance of 0~200 mm in an upstream side from a front end of the blowing tube for the solid reducing material in the lance simultaneously blowing the gaseous reducing material, the solid reducing material and oxygen;

(8) the blowing tube has an inner diameter of not less than 6 mm but not more than 30 mm;

(9) the blowing tube has an apical structure that a blowing stream of the combustible gas comes into collision with a blowing stream of the solid reducing material;

(10) the blowing tube for the combustible gas is provided at its front end part with a diameter-reducing portion;

(11) the diameter-reducing portion has a diameter that a blowing rate of the combustible gas is made to 20~200 m/s;

(12) the blowing tube has a structure that a front end is cut obliquely or a front end is bent;

(13) the lance simultaneously blowing the solid reducing material, the combustible gas and the gaseous reducing material is made by winding another blowing tubes around the blowing tube for the solid reducing material and integrally uniting them.

Effect of the Invention

According to the invention, a tube bundle-type lance having a structure that a plurality of blowing tubes are integrally bundled at a side-by-side state and housed in a main tube for lance is used when a solid reducing material, a combustible gas and a gaseous reducing material are blown into an inside of a blast furnace with a lance, so that the mutual blowing tubes can be kept at an independent state without increasing the outer diameter of the main tube for lance, and hence there can be attained not only the improvement of cooling capacity and the improvement of combustibility but also the decrease of consumption rate of reducing materials.

Also, according to the invention, the tube bundle-type lance used is made by arranging the blowing tube for the solid reducing material and the other blowing tubes side by side in one group and integrally uniting them at a state that a part thereof is wound, so that the gaseous reducing material and the combustible gas are moved around the solid reducing material side-by-side or in a spin, and hence the solid reducing material can be blown while being diffused. Therefore, combustion rate of the solid reducing material is more improved.

According to the invention, the diameter-reducing portion is formed in the front end part of the blowing tube for the combustible gas, so that the blowing rate of the combustible gas can be adjusted easily.

Furthermore, according to the invention, when the high volatile matter pulverized coal, the low volatile matter pulverized coal and further oxygen are simultaneously blown through the tube bundle-type lance, the front end of the blowing tube for the high volatile matter pulverized coal is set at a distance of 0~100 or 200 mm in an upstream side from the front end of the blowing tube for the low volatile matter pulverized coal, whereby the combustibility can be further improved.

According to the invention, when the solid reducing material, the gaseous reducing material and further oxygen are simultaneously blown into the inside of the furnace through the tube bundle-type lance, the front end of the blowing tube for the gaseous reducing material is set at a distance of 0~100 or 200 mm in an upstream side from the front end of the blowing tube for the solid reducing material, whereby the combustibility can be more improved.

EMBODIMENTS FOR CARRYING OUT THE INVENTION

Figure 1:
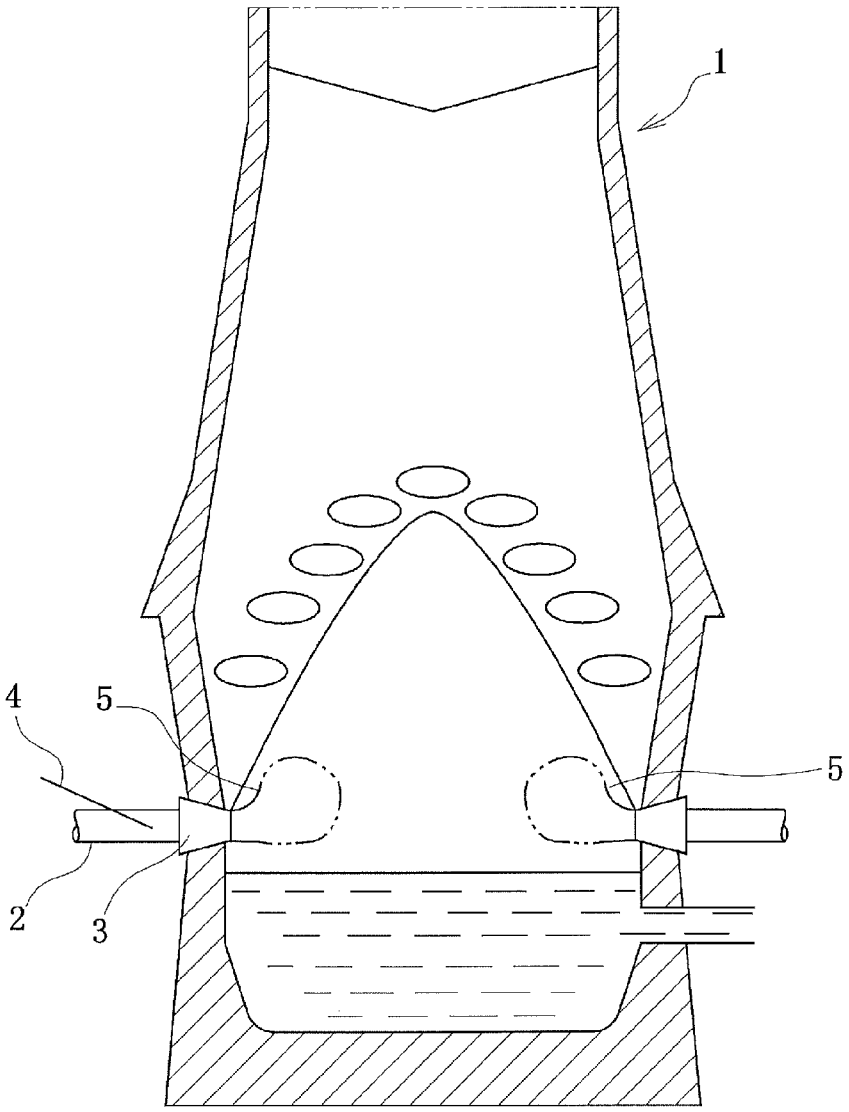
FIG. 1 is a longitudinal section view of an embodiment of the blast furnace.

An embodiment of the blast furnace operating method according to the invention will be described below. FIG. 1 is an overall view of a blast furnace 1 applied to this embodiment of the blast furnace operating method. The blast furnace 1 is provided on its bosch part with tuyeres 3, and each of the tuyeres 3 is connected to a blast pipe 2 for blowing hot air. In the blast pipe 2 is put a lance 4 for blowing a solid fuel or the like. A combustion space called as a raceway 5 is formed in a portion of coke deposited layer inside the furnace in front of a direction of hot air blown from the tuyere 3. A hot metal is mainly produced in this combustion space.

Figure 2:
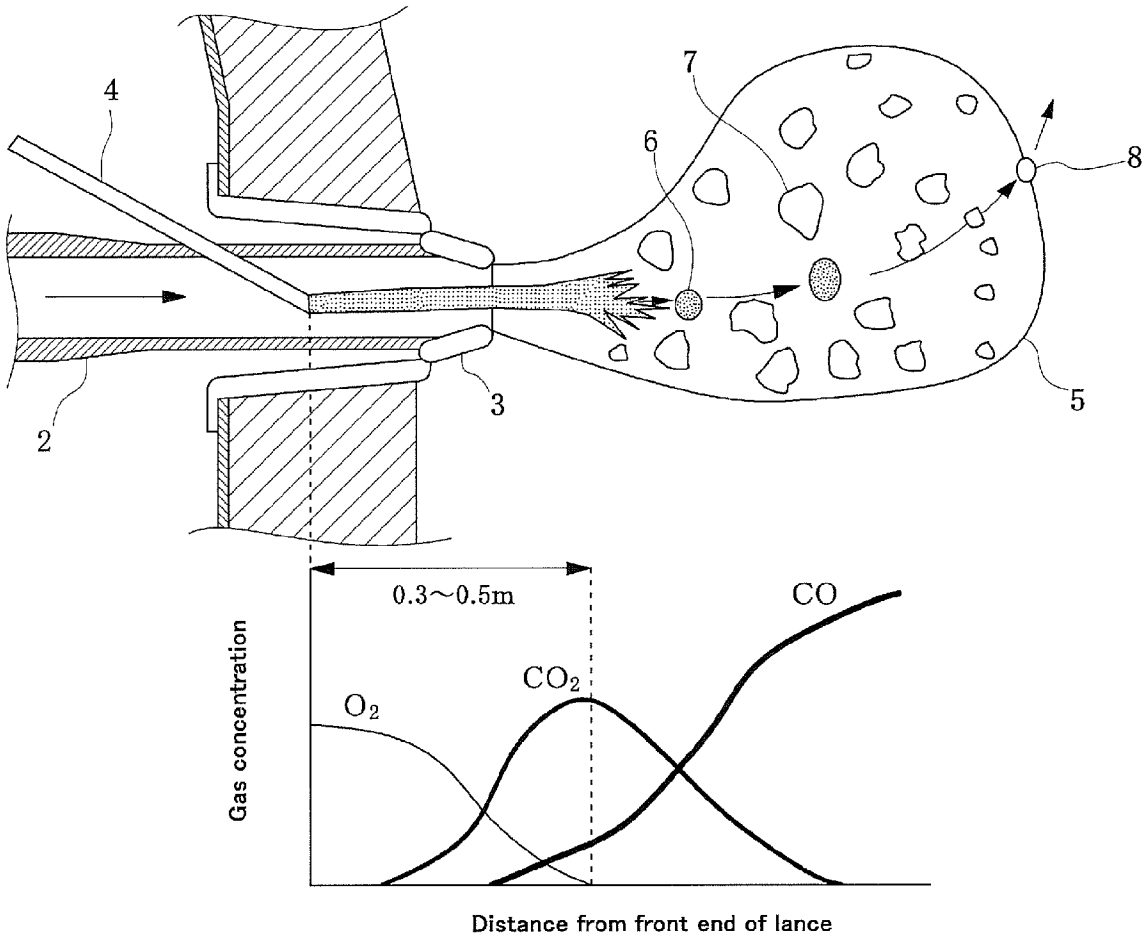
FIG. 2 is an illustration diagram of a combustion state when only pulverized coal is blown into an inside of a blast furnace through a lance.

FIG. 2 is a schematic view of a combustion state when only pulverized coal 6 as a solid reducing material is blown into the inside of the furnace from the lance 4 through the tuyere 3. As shown in this figure, volatile matter and fixed carbon of the pulverized coal 6 blown into the raceway 5 from the lance 4 through the tuyere 3 are burnt together with coke 7 deposited in the furnace, while an aggregate of unburned residual carbon and ash, i.e. char is discharged from the raceway 5 as an unburned char 8. Moreover, a rate of hot air in front of the direction of hot air blown from the tuyere 3 is about 200 m/sec. On the other hand, a distance from the front end portion of the lance 4 to the raceway 5, i.e. $O_2$ existing zone is about 0.3~0.5 m. Therefore, temperature rise of the pulverized coal particles blown or contact of the pulverized coal with $O_2$ (dispersibility) is necessary to be substantially performed in a short time of 1/1000 second.

Figure 3:
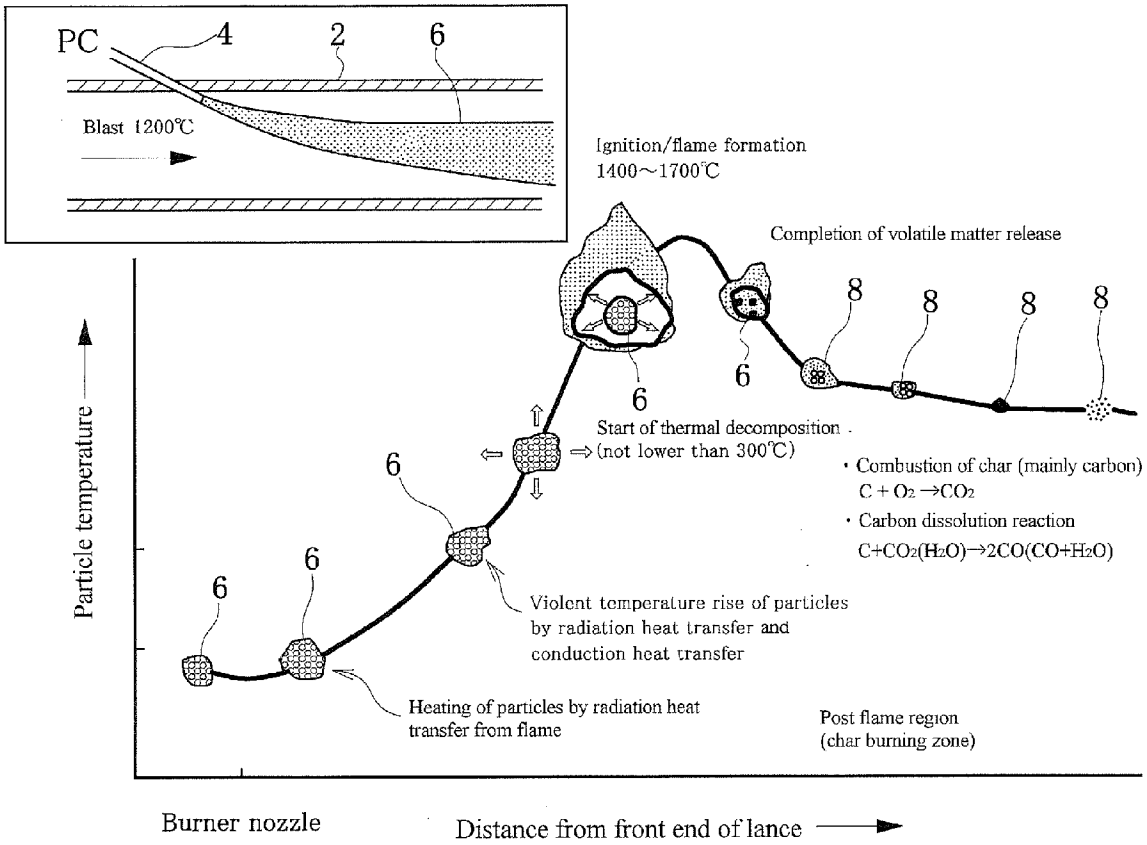
FIG. 3 is an illustration diagram of a combustion mechanism in case of blowing only pulverized coal.

FIG. 3 shows a combustion mechanism when only pulverized coal (PC: Pulverized Coal) 6 is blown into the blast pipe 2 through the lance 4. The particles of the pulverized coal 6 blown from the tuyere 3 into the raceway 5 are heated by radiation heat transfer from a flame in the raceway 5, and further temperature is raised by radiation heat transfer/conduction heat transfer, and thermal decomposition is started from a time that the temperature is raised to not lower than 300° C. and volatile matter is ignited and burnt (formation of flame) to reach to a temperature of 1400~1700° C. The pulverized coal after the emission of volatile matter is rendered into the unburned char 8. Since the char 8 is mainly composed of fixed carbon, carbon dissolution reaction is caused with the combustion reaction.

Figure 4:
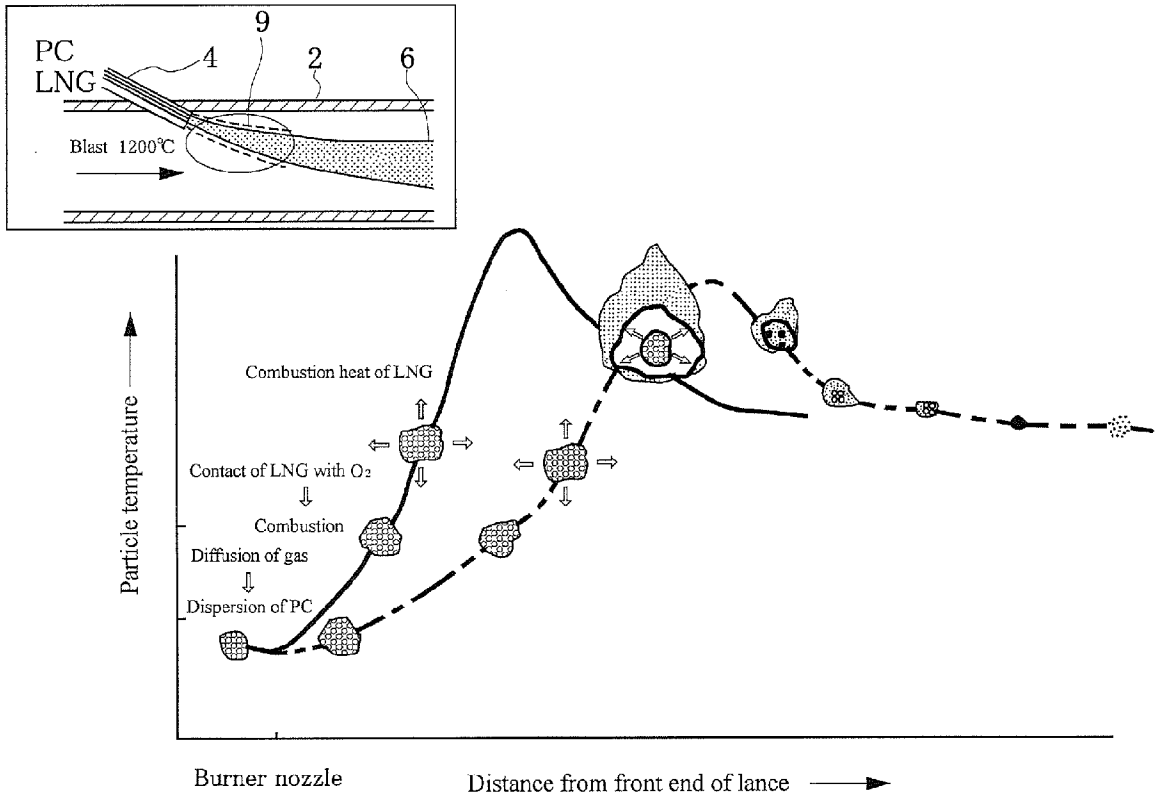
FIG. 4 is an illustration diagram of a combustion mechanism in case of blowing pulverized coal, LNG and oxygen.

FIG. 4 shows a combustion mechanism when LNG 9 and oxygen (the oxygen is not illustrated in this figure) are blown together with the pulverized coal 6 from the lance 4 into the blast pipe 2. The simultaneous blowing of the pulverized coal 6, LNG 9 and oxygen shows a case that they are blown in parallel simply. In this figure, a two-dot chain line shows a combustion temperature in case of blowing only the pulverized coal as shown in FIG. 3. Thus, when the pulverized coal, LNG and oxygen are blown simultaneously, the pulverized coal is dispersed associated with the diffusion of gas and LNG is burnt by contacting LNG with $O_2$ and the pulverized coal is rapidly heated by heat of the combustion to raise temperature, whereby the pulverized coal is burnt at a position near to the lance.

Figure 5:
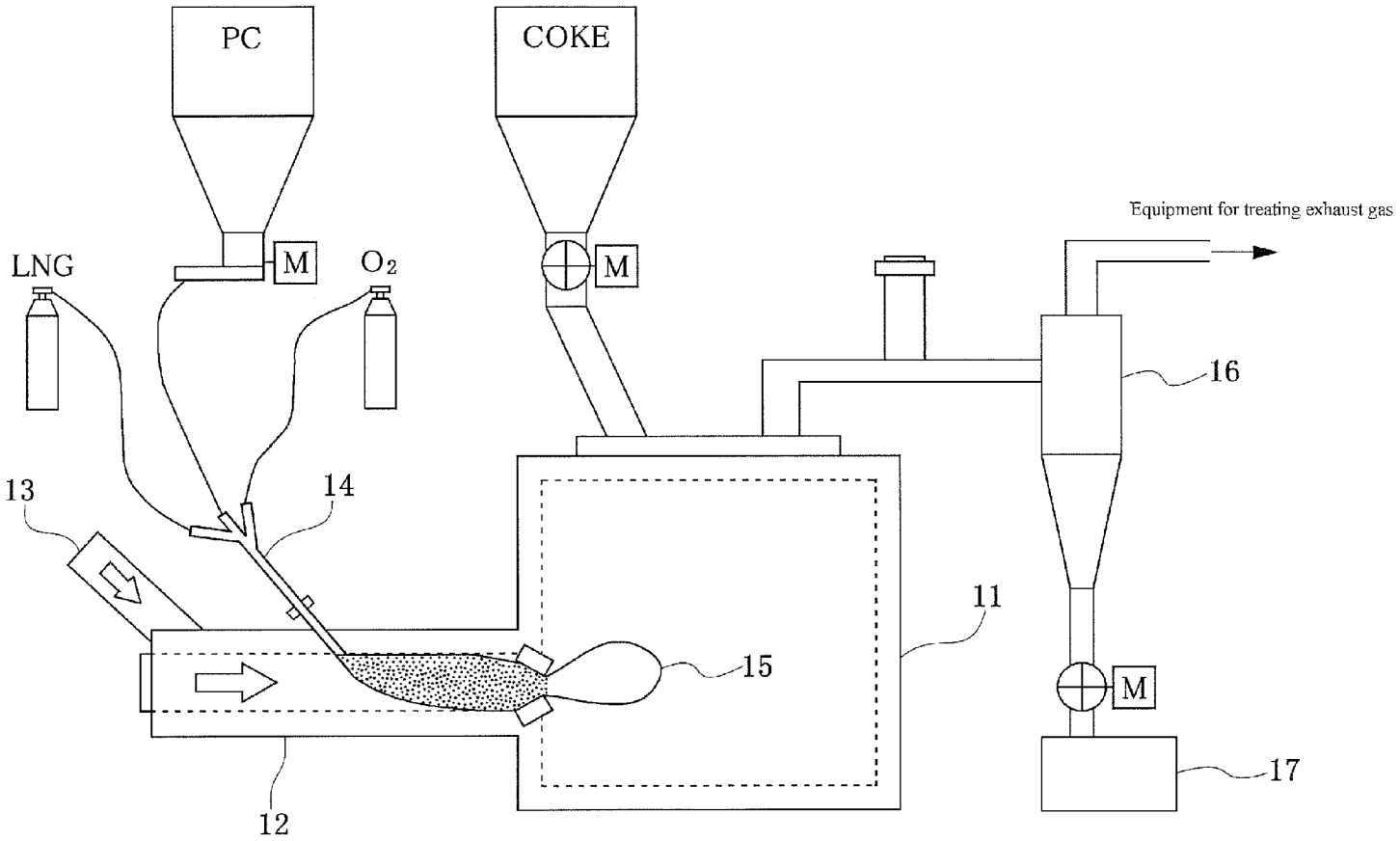
FIG. 5 is a schematic view of an apparatus for combustion test.

In order to confirm the above knowledge, the inventors have performed a combustion experiment with an apparatus for the combustion experiment simulating a blast furnace as shown in FIG. 5. In an experimental furnace 11 used in this apparatus is filled coke, and an interior of a raceway 15 can be observed from an inspection window. To this apparatus is attached a blast pipe 12, in which hot air generated by an exterior combustion burner 13 can be blown through the blast pipe 12 into the inside of the experimental furnace 11. In the blast pipe 12 is inserted a lance 4. It is possible to enrich oxygen during the air blowing in the blast pipe 12. Moreover, the lance 4 can blow one or more of pulverized coal, LNG and oxygen through the blast pipe 12 into the experimental furnace 11. On the other hand, gas generated in the experimental furnace 11 is separated into exhaust gas and dusts in a separation device 16 called as a cyclone, in which the exhaust gas is fed to an equipment for treating the exhaust gas such as auxiliary combustion furnace or the like and the dusts are collected in a collection box 17.

In the combustion experiment are used a single tube lance, a coaxially multiple tube lance (hereinafter referred to as "multiple tube type lance") and a tube bundle-type lance formed by bundling 2~3 blowing tubes at a side-by-side state and housing them in a main tube for lance along an axial direction thereof as the lance 4. The combustion rate, pressure loss in the lance, surface temperature of lance and outer diameter of lance are measured (1) when only the pulverized coal is blown through the single tube lance, (2) when the pulverized coal is blown through an inner tube and oxygen is blown from a gap between inner tube and middle tube and LNG is blown from a gap between middle tube and outer tube in the conventional multiple tube type lance, and (3) when one or more of pulverized coal, LNG and oxygen are blown through the respective blowing tubes in the tube bundle-type lance inherent to the invention. The combustion rate is measured by changing the blowing rate of oxygen. The combustion rate is determined by recovering unburned char from behind the raceway with a probe and measuring an amount of unburned char.

Figure 6:
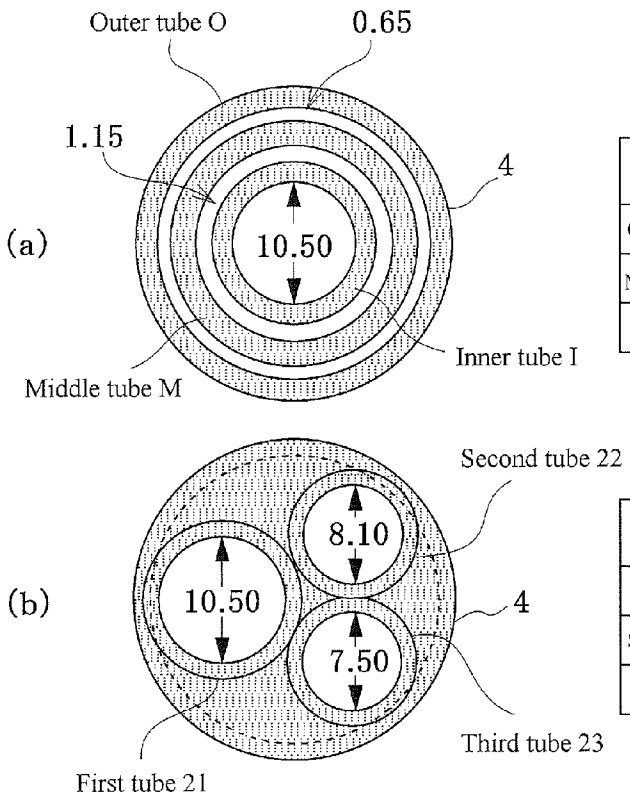
FIG. 6 is an illustration diagram of blowing tubes in a lance.

FIG. 6(*a*) shows an example of the conventional multiple tube type lance, and FIG. 6(*b*) shows an example of the tube bundle-type lance according to the invention. In the multiple tube type lance, a stainless steel pipe having a nominal diameter of 8 A and a nominal thickness of Schedule 10S is used as an inner tube I, and a stainless steel pipe having a nominal diameter of 15 A and a nominal thickness of 40 is used as a middle tube M, and a stainless steel pipe having a nominal diameter of 20 A and a nominal thickness of Schedule 10S is used as an outer tube. The dimension of each of the stainless steel pipes is shown in this figure, and a gap between the inner tube I and the middle tube M is 1.15 mm, and a gap between the middle tube M and the outer tube O is 0.65 mm.

In the tube bundle-type lance, a stainless steel pipe having a nominal diameter of 8 A and a nominal thickness of Schedule 5S is used as the first tube 21, and a stainless steel pipe having a nominal diameter of 6 A and a nominal thickness of 10 A is used as the second tube 22, and a stainless steel pipe having a nominal diameter of 6 A and a nominal thickness of 20S is used as the third tube 23, wherein these pipes are bundled at a side-by-side state. Each of the stainless steel pipes is as shown in the figure.

Figure 7:
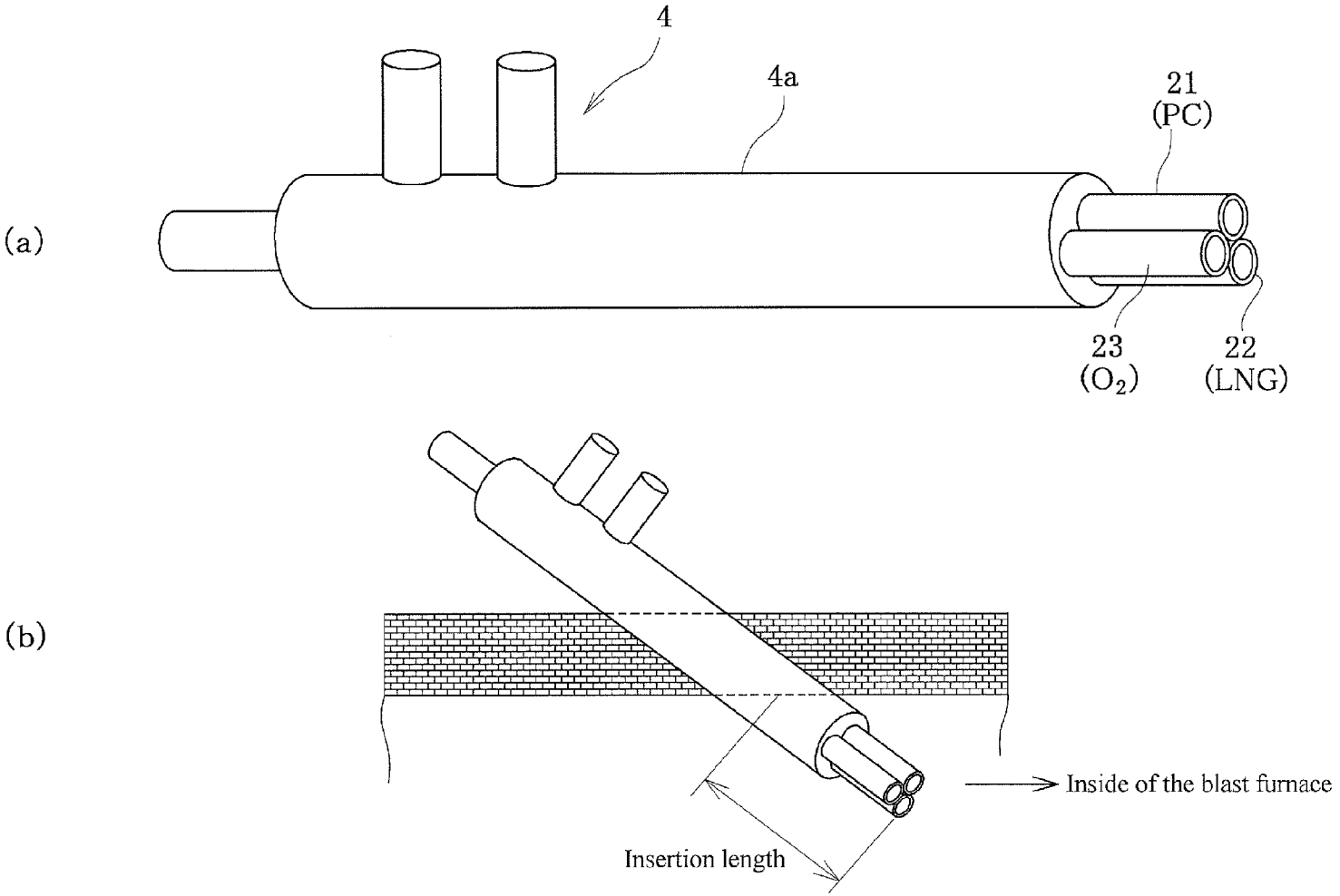
FIG. 7 is an outline view and a layout view of a tube bundle-type lance according to the invention.
Figure 8:
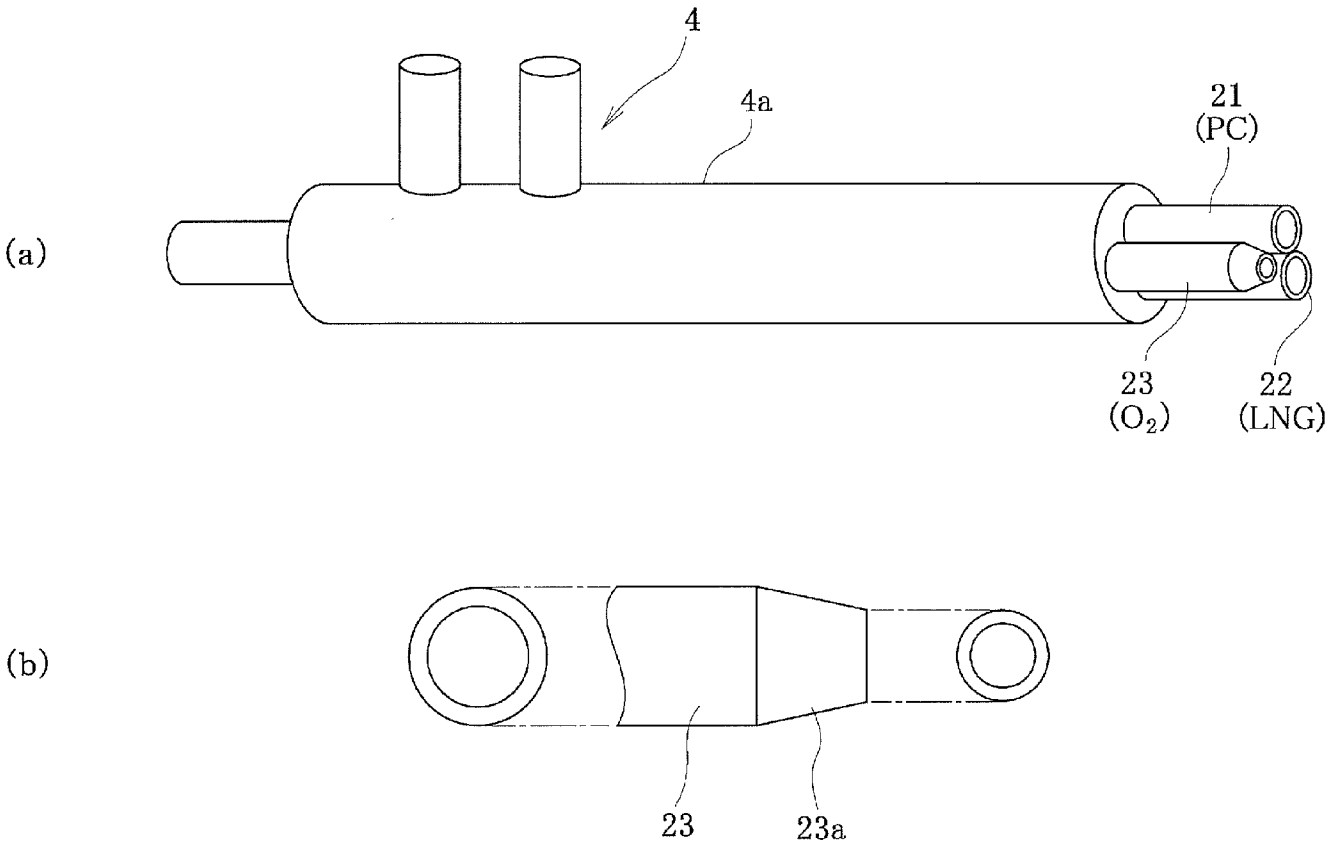
FIG. 8 is an outline view of another example of the tube bundle-type lance according to the invention.

In the tube bundle-type lance formed by bundling and housing 2~3 blowing tubes at a side-by-side state in a main tube 4*a* for lance as shown in FIG. 7(*a*), pulverized coal (PC) is blown through the first tube 21, and LNG is blown through the second tube 22, and oxygen is blown through the third tube 23. Moreover, the insertion length of the tube bundle-type lance into a blast pipe (blow pipe) is 200 mm as shown in FIG. 7(*b*). Also, the flow rate of oxygen is 10~200 m/s, and the lance is inserted obliquely so as to direct the front end thereof toward the inside of the blast furnace. Further, the flow rate adjustment of oxygen is conducted, for example, by arranging a diameter-reducing portion 23*a* in the front end part of the third tube 23 for blowing oxygen as shown in FIG. 8 and variously changing an inner diameter of a front end of the diameter-reducing portion 23*a*.

Figure 9:
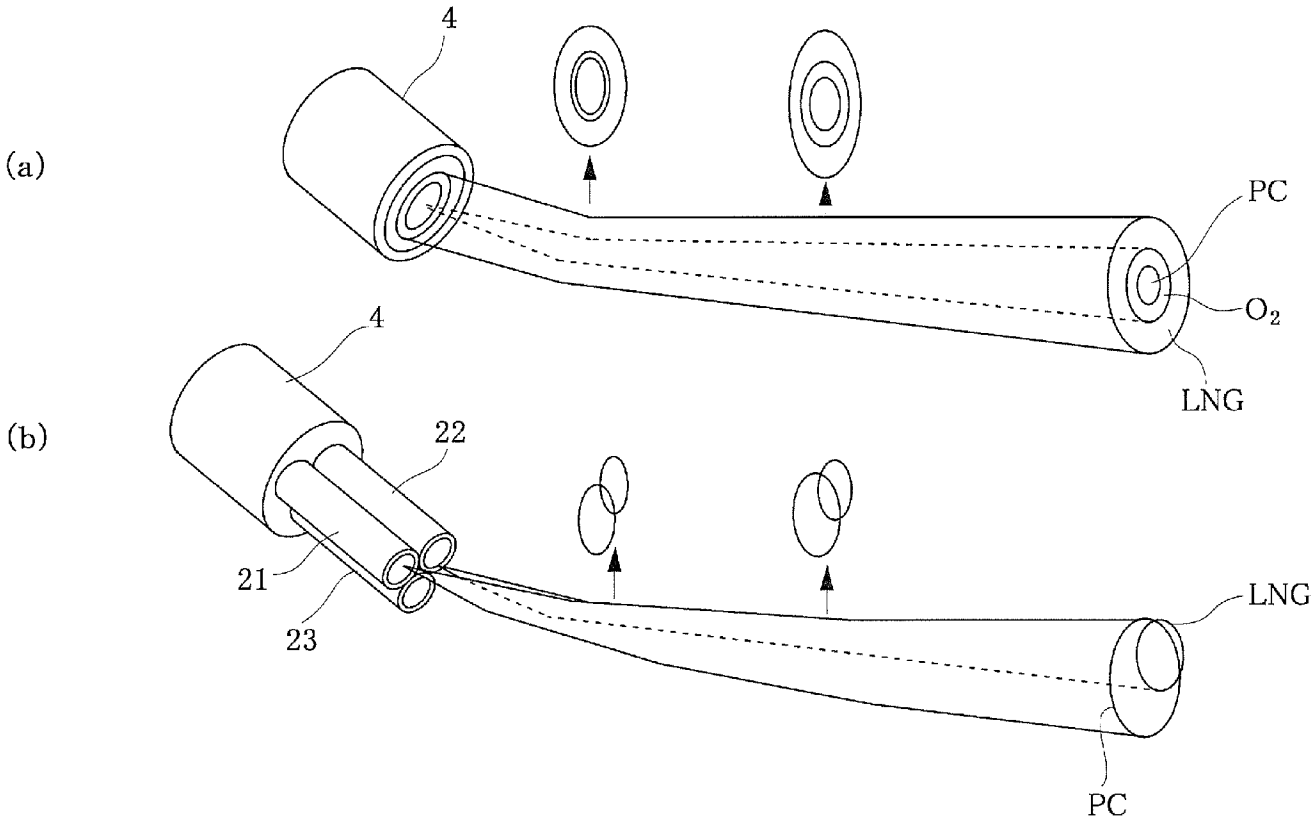
FIG. 9 is an illustration diagram of a blowing state through a lance.

In the blowing, it is preferable to perform adjustment so that LNG and oxygen collide on the blowing stream of pulverized coal (main stream). FIG. 9(*a*) shows a concept of a blowing state through the multiple tube type lance 4, and FIG. 9(*b*) shows a concept of a blowing state through the tube bundle-type lance. As seen from the construction of FIG. 6(*a*), the pulverized coal, oxygen and LNG are blown in the conventional multiple tube type lance in a concentric fashion without colliding to each other as shown in FIG. 9(*a*). On the contrary, the pulverized coal stream, oxygen stream and LNG stream can be controlled in the tube bundle-type lance, for example, by adjusting the structure of the blowing front end, respectively. An example shown in FIG. 9(*b*) is a front end structure of the lance that LNG and oxygen (oxygen stream is not shown) are collided on the main stream of the pulverized coal.

Figure 10:
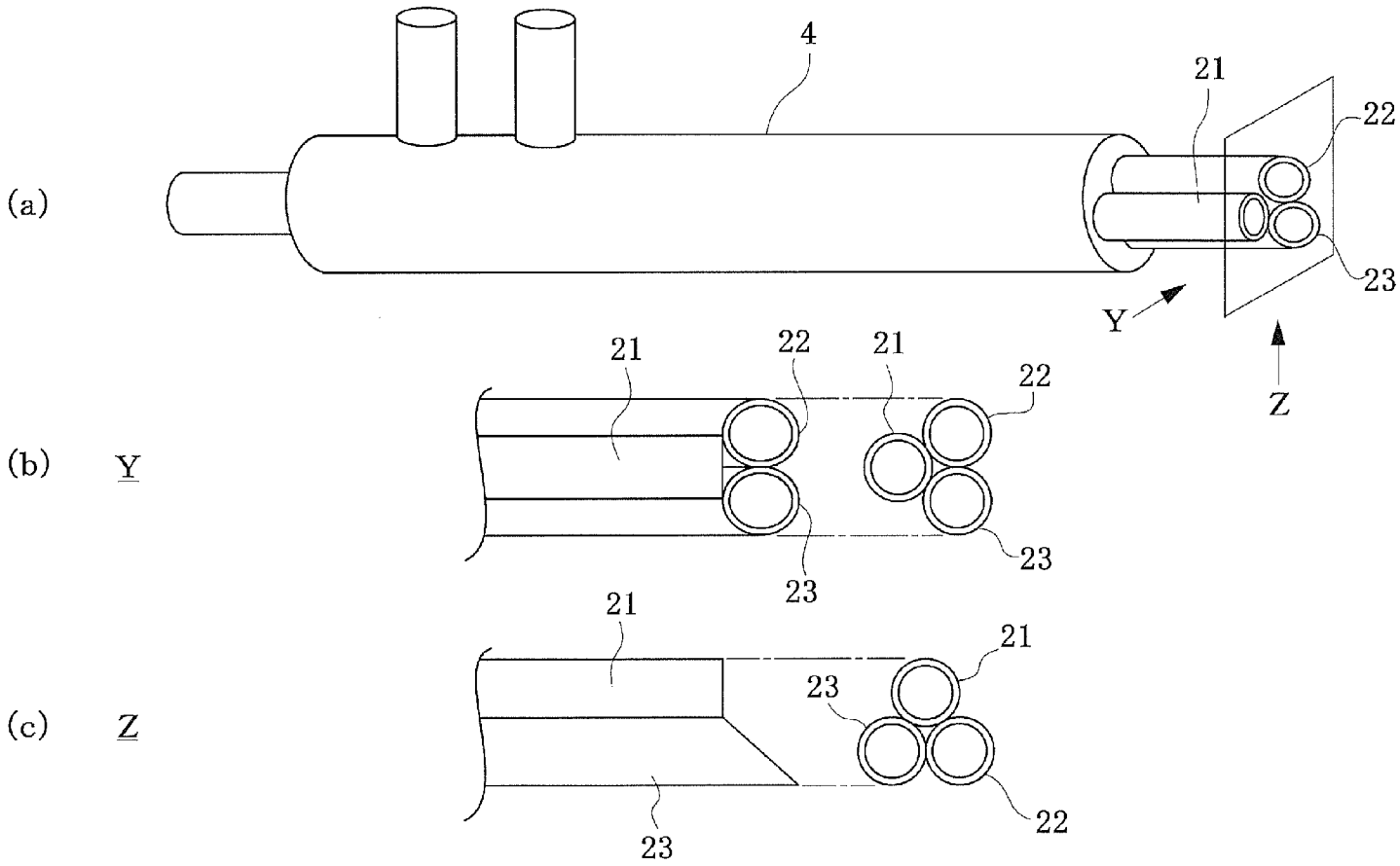
FIG. 10 is an outline view of the other example of the tube bundle-type lance according to the invention.
Figure 11:
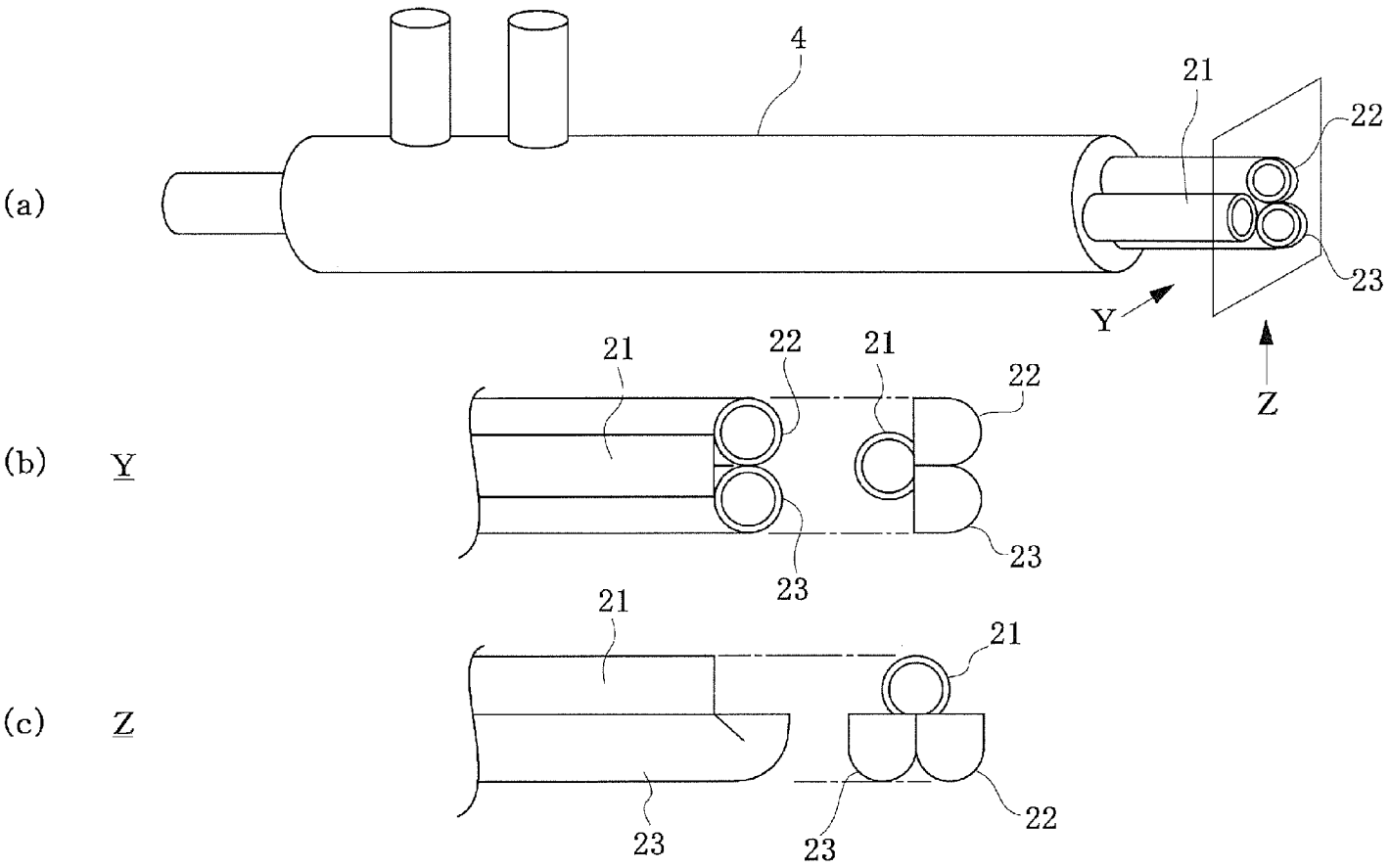
FIG. 11 is an outline view of a further example of the tube bundle-type lance according to the invention.

As a front end structure of the blowing tubes can be applied a structure that the front end is cut obliquely as shown in FIG. 10 and a structure that the front end is bent as shown in FIG. 11. Among them, FIG. 10 shows a case that front ends of the second tube 22 for blowing LNG and the third tube 23 for blowing oxygen are cut obliquely. Thus, diffusion states of LNG and oxygen blown can be changed by cutting the front ends of the blowing tubes obliquely. FIG. 11 shows a case of bending the front ends of the second tube 22 for blowing LNG and the third tube 23 for blowing oxygen. Thus, the flow directions of LNG and oxygen blown can be changed by bending the front ends of the blowing tubes.

An average pulverized coal as a solid reducing material used in the invention is preferable to contain 71.3% of fixed carbon (FC: Fixed Carbon), 19.6% of volatile matter (VM: Volatile Matter) and 9.1% of ash (Ash). The pulverized coal is preferably blown under a blowing condition of 50.0 kg/h (corresponding to 158 kg/t as a hot metal unit). The blowing condition of LNG is preferable to be 3.6 kg/h (5.0 $Nm^3/h$, corresponding to 11 kg/t as a hot metal unit). The blast condition is preferable to be an blast temperature of 1100° C., a flow amount of 350 $Nm^3/h$, a flow rate of 80 m/s and $O_2$ enriching of +3.7 (oxygen concentration 24.7%, enriching of 3.7% with respect to oxygen concentration in air of 21%).

Figure 12:
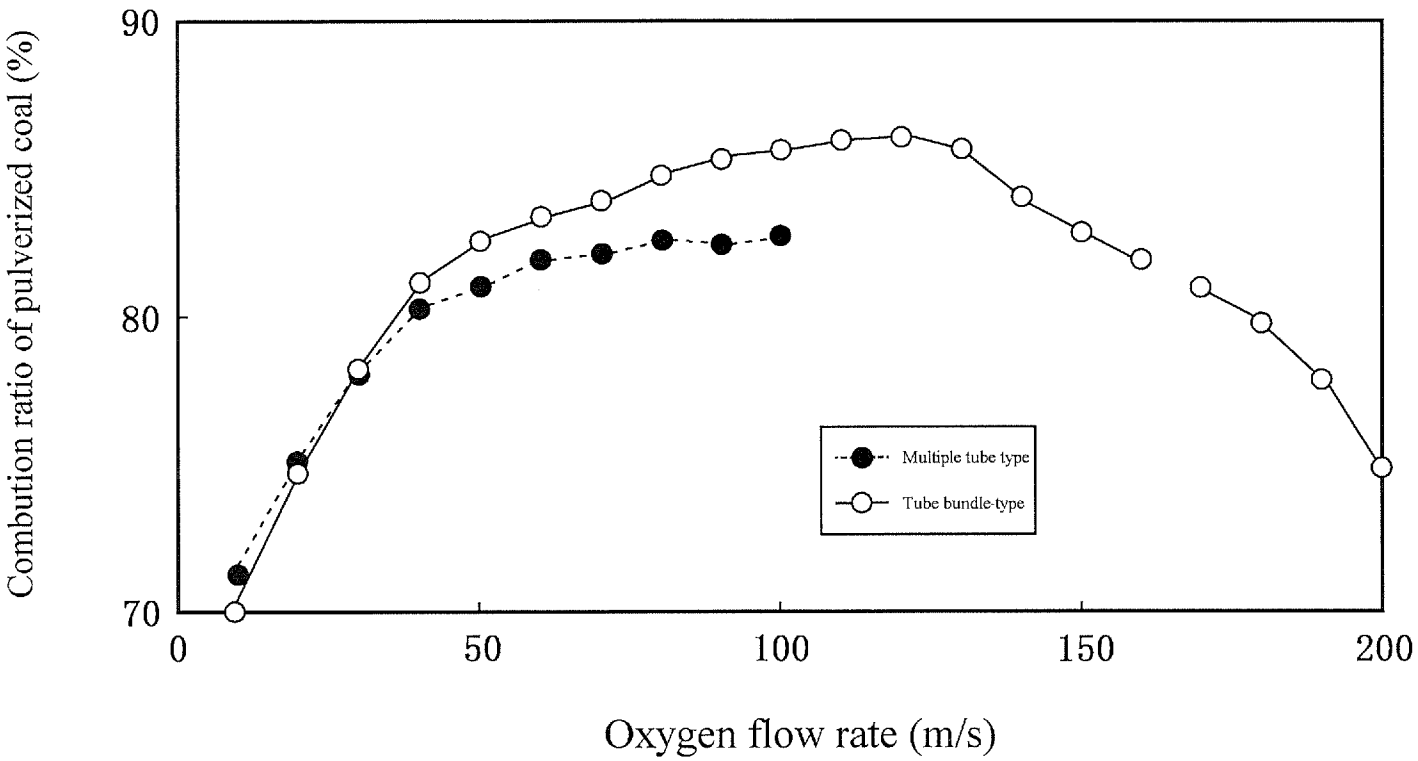
FIG. 12 is a graph showing a relation between oxygen flow rate and combustion rate in results of combustion test.

FIG. 12 is a diagram showing a relation between oxygen flow rate and combustion rate in the above combustion experiment. As seen from this figure, the combustion rate of the pulverized coal increases with the increase of the oxygen flow rate when the oxygen flow rate ranges to 100 m/s in the multiple tube type lance and when the oxygen flow rate ranges to 150 m/s in the tube bundle-type lance. In case of the multiple tube type lance, it is considered that oxygen blown from the lance and diffused in hot air (hereinafter referred to as "lance-derived oxygen") decreases with the increase of the flow rate and the ratio of the lance-derived oxygen to be mixed with pulverized coal increases. In case of the tube bundle-type lance, it is considered that the lance-derived oxygen diffused in hot air decreases with the increase of the oxygen flow rate, while the lance-derived oxygen consumed by combustion of volatile matter or LNG decreases and the ratio of the lance-derived oxygen to be mixed with pulverized coal increases. Moreover, the reason why there are data on the combustion rate in the multiple tube type lance only in the oxygen flow rate up to not more than 100 m/s is due to the fact that the pressure loss is critical. On the other hand, the combustion rate lowers at a zone of oxygen flow rate of not less than 150 m/s, which is due to the fact that the flow rate of the lance-derived oxygen approaches to the flow rate of hot air and the oxygen stream flows in parallel to the pulverized coal stream and hence the lance-derived oxygen reaches to the back of the raceway without being mixed with the pulverized coal.

Figure 13:
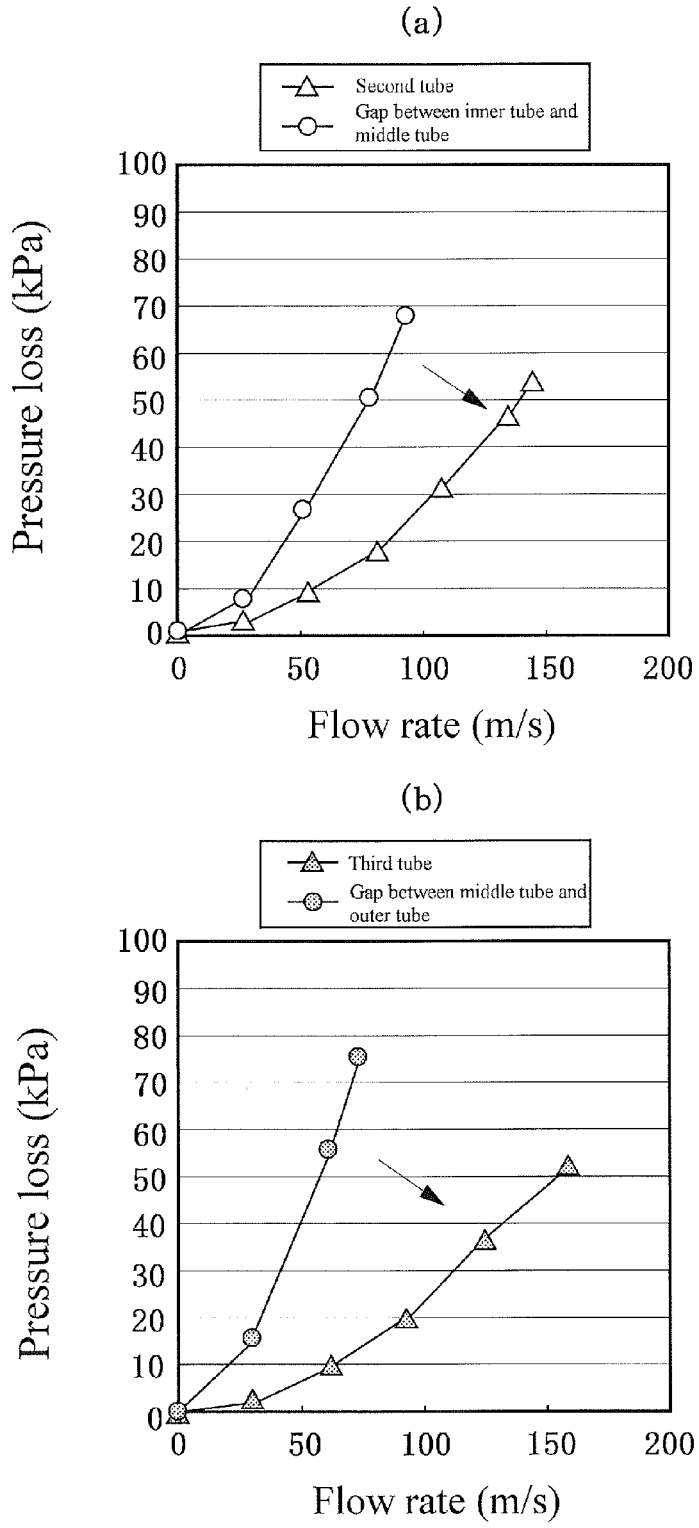
FIG. 13 is a graph showing a relation between flow rate and pressure loss in results of combustion test.

FIG. 13 shows results of pressure loss measured on the multiple tube type lance (○ mark) and the tube bundle-type lance (Δ mark). As the multiple tube type lance is used a triple tube lance obtained by arranging three stainless steel pipes of various sizes in a concentric fashion. In the triple tube lance, a stainless steel pipe having a nominal diameter of 8 A and a nominal thickness of Schedule 10S (inner diameter: 10.50 mm, outer diameter: 13.80 mm, gauge: 1.65 mm) is used as an inner tube, and a stainless steel pipe having a nominal diameter of 15 A and a nominal thickness of Schedule 40 (inner diameter: 16.10 mm, outer diameter: 21.70 mm, gauge: 2.8 mm) is used as a middle tube, and a stainless steel pipe having a nominal diameter of 20 A and a nominal thickness of Schedule 10S (inner diameter: 23.00 mm, outer diameter: 27.20 mm, gauge: 2.1 mm) is used as an outer tube. Moreover, the gap between the inner tube and the middle tube is 1.15 mm, and the gap between the middle tube and the outer tube is 0.65 mm. As seen from this figure, the pressure loss at the same sectional area becomes small in the tube bundle-type lance as compared to the multiple tube type lance. This is considered due to the fact that the interval of the gap is increased to reduce the permeation resistance.

Figure 14:
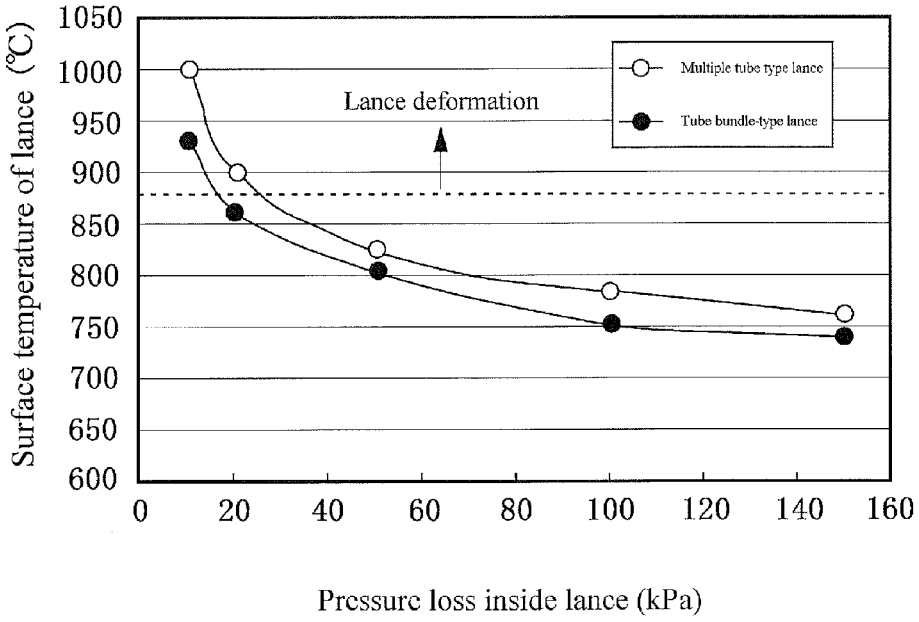
FIG. 14 is a graph showing a relation between pressure loss in a lance and surface temperature of a lance in results of combustion test.

FIG. 14 shows experimental results on cooling capacity of lance. As seen from this figure, the cooling capacity under the same pressure loss becomes higher in the tube bundle-type lance as compared to the multiple tube type lance. This is considered due to the fact that the permeation resistance is low and the flow amount capable of flowing under the same pressure loss is large.

Figure 15:
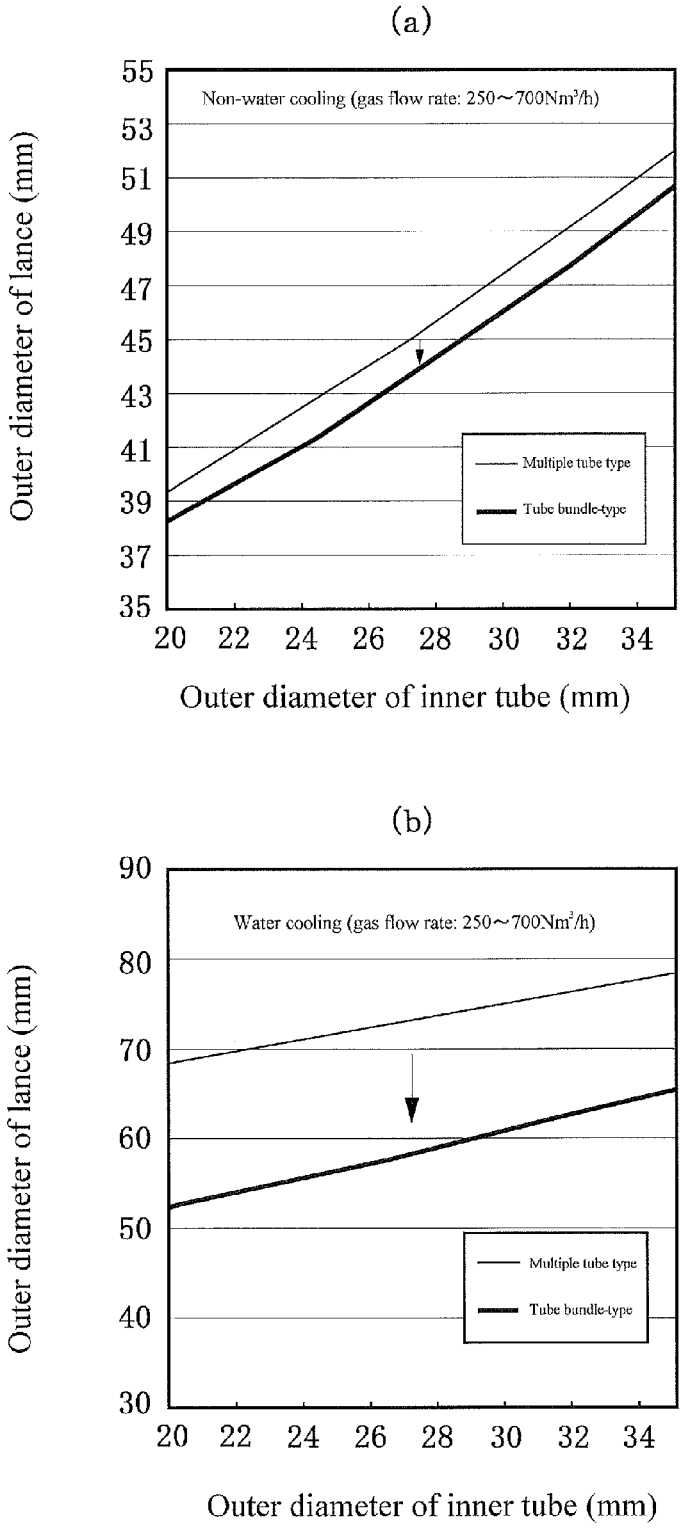
FIG. 15 is a graph showing a relation between outer diameter of an inner tube and outer diameter of a lance in results of combustion test.

FIG. 15 exemplifies an outer diameter of a lance. FIG. 15(*a*) is an example of a non-water cooling type lance, and FIG. 15(*b*) is an example of water cooling-type lance. As seen from these figures, the outer diameter of the lance becomes smaller in the tube bundle-type lance as compared to the multiple tube type lance. This is considered due to the fact that the flow path, tube gauge and sectional area of the water cooling portion can be decreased in the tube bundle-type lance as compared to the multiple tube type lance.

Figure 16:
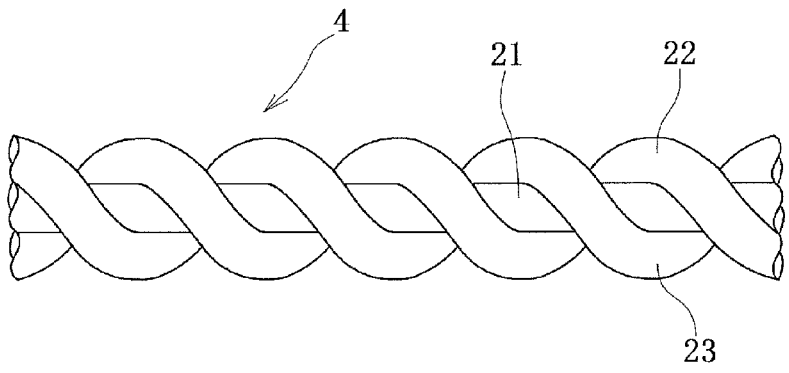
FIG. 16 is a schematic view of another example of blowing tubes in a lance.

Moreover, there can be used a tube bundle-type lance 4 of the blowing tubes housed in the lance 4 at a side-by-side state wherein the blowing tube for blowing the pulverized coal or the first tube 21 is wound with the other blowing tubes or the second tube 22 and third tube 23 and integrally united as shown, for example, in FIG. 16. By using such a lance 4 is fluidized LNG stream and oxygen stream around the pulverized coal stream in a whirl, so that the pulverized coal can be blown while scattering and the combustion rate of the pulverized coal can be improved more.

The lance is easily exposed to a high temperature associated with the rise of the combustion temperature as previously mentioned. In general, the lance is constructed with the stainless steel pipe. Although there is an example that water cooling called as water jacket is applied to an outside of the lance, the front end of the lance cannot be covered therewith. Especially, it has been confirmed that the front end part of the lance not subjected to water cooling is easily deformed by heat. If the lance is deformed or bent, the gas or pulverized coal cannot be blown into a desired site and there is a trouble in the operation of exchanging the lance as consumable goods. Also, it is considered that the stream of pulverized coal is changed to collide on the tuyeres. In this case, there is a fear of damaging the tuyeres. For example, if the outer tube is bent in the multiple tube type lance, the gap to the inner tube is clogged so as not to flow the gas through the outer tube and hence the outer tube of the multiple tube type lance is melted down and occasionally there is a possibility that the blast pipe is broken. If the lance is deformed or melted down, the combustion temperature cannot be ensured as previously mentioned and hence the consumption rate of the reducing material cannot be reduced.

In order to cool the lance incapable of being subjected to water cooling, the lance is only cooled with a gas flowing in the inside thereof. For example, when heat is dissipated to the gas flowing in the inside of the lance to cool the lance itself, it is considered that the flow rate of the gas affects the lance temperature. Therefore, the inventors have measured the surface temperature of the lance by variously changing the flow rate of the gas blown from the lance. The experiment is performed by blowing oxygen through outer tube of a double tube lance and blowing pulverized coal through an inner tube thereof, and the adjustment of flow rate of the gas is performed by controlling an amount of oxygen blown through the outer tube. Moreover, oxygen may be oxygen-enriched air, in which enriched air having an oxygen content of not less than 2%, preferably not less than 10% is used. By using oxygen-enriched air is attained the improvement of combustion rate of pulverized coal in addition to the cooling. The measured results are shown in FIG. 17.

As the outer tube of the double tube lance is used a steel pipe of 20 A/Schedule 5S. As the inner tube of the double tube lance is used a steel pipe of 15 A/Schedule 90. The surface temperature of the lance is measured by variously changing a total flow rate of oxygen and nitrogen blown through the outer tube. Incidentally, "15 A" and "20 A" are a nominal size of an outer diameter of the steel pipe defined in JIS G 3459, wherein 15 A is an outer diameter of 21.7 mm and 20 A is an outer diameter of 27.2 mm. Also, "Schedule" is a nominal size of a gauge of the steel pipe defined in JIS G 3459, wherein 20 A/Schedule 5S is 1.65 mm and 15 A/Schedule 90 is 3.70 mm. Moreover, common steel may be used in addition to the stainless steel pipe. In the latter case, the outer diameter of the steel pipe is defined in JIS G 3452 and the gauge thereof is defined in JIS G 3454.

Figure 17:
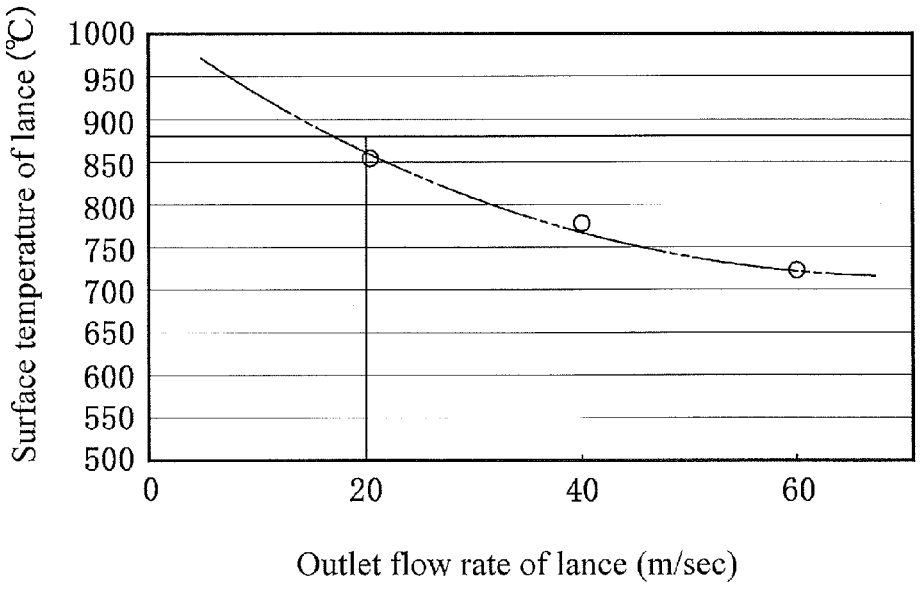
FIG. 17 is a graph showing a relation between outlet flow rate of a lance and surface temperature of a lance.

As shown by two-dot chain line in FIG. 17, the surface temperature of the lance is lowered associated with the increase of the flow rate of the gas blown through the outer tube of the double tube lance. Further, when the steel pipe is used in the double tube lance and the surface temperature of the lance exceeds 880° C., creep deformation is caused to bend the lance. Therefore, when a steel pipe of 20 A/Schedule 5S is used as an outer tube of the double tube lance and the surface temperature of the double tube lance is not higher than 880° C., the outlet flow rate of the outer tube in the double tube lance is not less than 20 m/sec. The double tube lance does not cause the deformation or bending at the outlet flow rate of not less than 20 m/sec. On the other hand, when the outlet flow rate of the outer tube in the double tube lance exceeds 120 m/sec, the lance does not come into practice in view of the operational cost of the equipment, so that the upper limit of the outlet flow rate is 120 m/sec. Incidentally, since heat burden is less in the single tube lance as compared to the double tube lance, the outlet flow rate may be not less than 20 m/sec, if necessary.

In the embodiments of the invention, the blowing tubes constituting the tube bundle-type lance are preferable to have an inner diameter of not less than 7 mm but not more than 30 mm. When the inner diameter of the blowing tube is less than 7 mm, clogging is easily caused in consideration with clogging with pulverized coal or the like. Therefore, the inner diameter of the assembled blowing tubes inclusive of the blowing tube for blowing the pulverized coal is made to not less than 7 mm. Also, when it is considered to cool the blowing tube with the gas flowing in the blowing tube as previously mentioned, if the inner diameter of the blowing tube exceeds 30 mm, it is difficult to increase the flow rate of the gas and hence poor cooling is caused. Therefore, the inner diameter of the blowing tube is not more than 30 mm. Preferably, it is not less than 8 mm but not more than 25 mm.

As mentioned above, when the pulverized coal (solid reducing material) 6, LNG (gaseous reducing material) 9 and oxygen (combustible gas) are simultaneously blown into the tuyere part 3 through the lance 4 in the blast furnace operating method according to the embodiment of the invention, the gap between the respective blowing tubes can be kept large without extremely increasing the outer diameter of the tube bundle-type lance, and hence the securement of cooling capacity and the improvement of combustibility can be established. As a result, the consumption rate of the reducing material can be reduced.

As another embodiment, even if two kinds of the solid reducing materials, i.e. a high volatile matter pulverized coal and a low volatile matter pulverized coal are simultaneously blown into the tuyere through the lance 4 instead of blowing the aforementioned pulverized coal, LNG and oxygen into the inside of the furnace through the lance 4, the gap between the mutual blowing tubes can be kept large without extremely increasing the outer diameter of the lance and the necessary cooling capacity can be ensured. When the front end of the blowing tube for blowing the high volatile matter pulverized coal (solid reducing material) is set to 0~200 mm, preferably about 0~100 mm from the front end of the blowing tube for blowing the low volatile matter pulverized coal (solid reducing material) at an upstream side, the combustibility can be improved and the consumption rate of the reducing material can be reduced.

As the blast furnace operation method according to the other embodiment, it is considered to simultaneously blow LNG (gaseous reducing material) and the pulverized coal (solid reducing material) into the tuyere through the lance. In this case, the tube bundle-type lance obtained by bundling plural blowing tubes at a side-by-side state and housing in a main tube for lance is used, whereby the outer diameter of the lance is not increased extremely and the gap between the mutual blowing tubes can be kept large and the necessary cooling capacity can be ensured. Further, the front end of the blowing tube for blowing LNG (gaseous reducing material) is set to about 0~200 mm from the front end of the blowing tube for blowing the pulverized coal (solid reducing material) at an upstream side, whereby the combustibility can be improved and hence the consumption rate of the reducing material can be reduced.

By using the lance 4 formed by winding the second tube 22 and third tube 23 around the first tube 21 for blowing the pulverized coal and integrally uniting them are moved LNG stream and oxygen stream around the pulverized coal stream in a whirl, whereby the pulverized coal can be blown while scattering and hence the combustion rate of the pulverized coal can be improved more.

Also, a diameter-reducing portion is formed in the front end portion of the third tube 23 for blowing oxygen, whereby the flow rate of oxygen blown can be easily adjusted.

In the latter embodiment, the following high volatile matter pulverized coal and low volatile matter pulverized coal can be used as the solid reducing material. In this case, a pulverized coal having a volatile matter (VM: Volatile Matter) of not less than 25% is classified to a high volatile matter pulverized coal, and a pulverized coal having a volatile matter of less than 25% is classified to a low volatile matter pulverized coal. The low volatile matter pulverized coal has a fixed carbon (FC: Fixed Carbon) of 71.3%, a volatile matter of 19.6% and an ash (Ash) of 9.1% and a blowing condition thereof is 25.0 kg/h (corresponding to 79 kg/t as a hot metal unit). The high volatile matter pulverized coal has a fixed carbon of 52.8%, a volatile matter of 36.7% and an ash of 10.5% and a blowing condition thereof is 25.0 kg/h (corresponding to 79 kg/t as a hot metal unit). The blast condition is an blast temperature of 1100° C., a flow amount of 350 $Nm^3/h$, a flow rate of 80 m/s, and O2 enriching of +3.7 (oxygen concentration: 24.7%, enriched by 3.7% to oxygen concentration in air of 21%).

Figure 18:
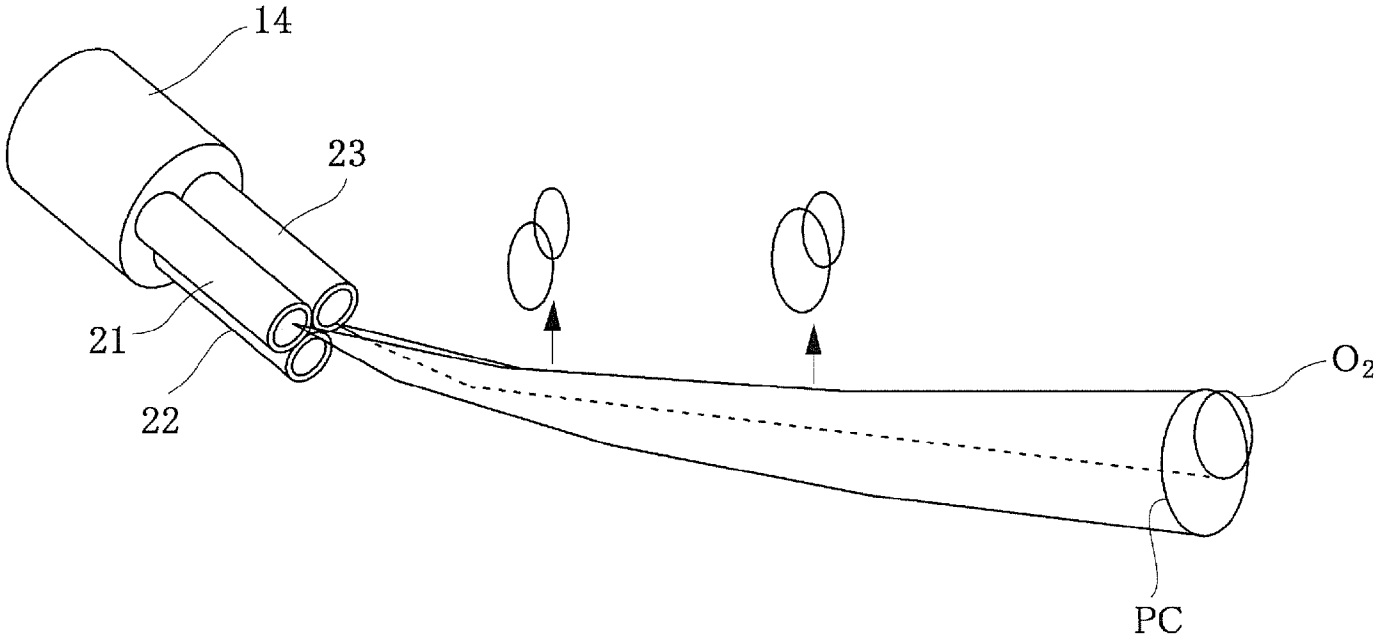
FIG. 18 is a schematic view of a blowing state through a lance.
Figure 19:
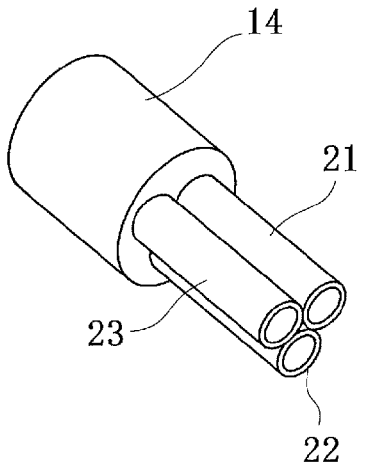
FIG. 19 is a schematic view of front end portions of blowing tubes in a lance.
Figure 19:
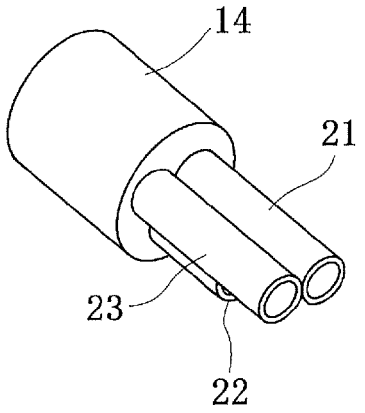
Figure 19:
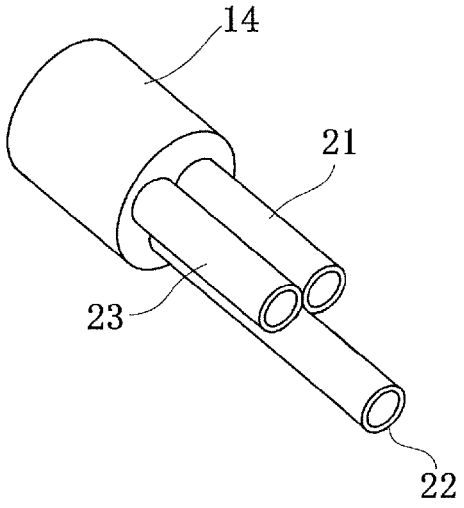

As to the blowing tube for the high volatile matter pulverized coal, the position of the front end of the second tube 22 (distance) can be changed variously as follows. When the front end of the lance in the insertion direction is defined as side interior of furnace and the opposite side thereof is defined as blast side as shown in FIG. 18, the position is same as the front ends of the first tube 21 and the third tube 23 as shown in FIG. 19(*a*), or the blast side from the front ends of the first tube 21 and third tube 23 as shown in FIG. 19(*b*), or side interior of furnace from the front ends of the first tube 21 and third tube 23 as shown in FIG. 19(*c*).

Figure 20:
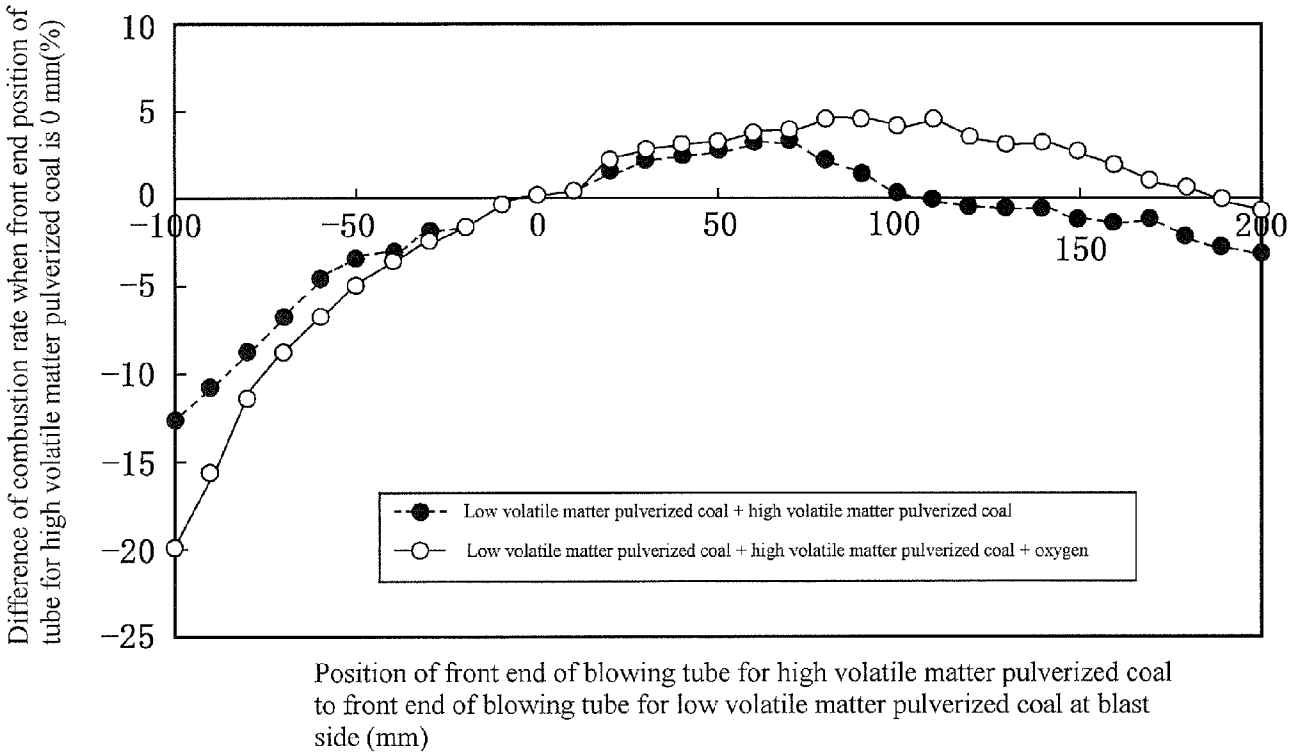
FIG. 20 is a graph showing an influence of a blowing material upon combustion rate in results of combustion test (use of high and low volatile matter pulverized coals).

FIG. 20 shows a combustion rate in the above combustion experiment. A horizontal axis in the figure is a position (mm) of a front end of a blowing tube for high volatile matter pulverized coal or second tube 22 to a front end of a blowing tube for low volatile matter pulverized coal or second tube 22 at a blast side. Also, a vertical axis in the figure is a difference of combustion rate when the front end of the tube for blowing the high volatile matter pulverized coal or second tube 22 is the same position as the front end of the tube for blowing the low volatile matter pulverized coal or first tube 21 (0 mm). In this figure, black circle is a case that the high volatile matter pulverized coal and the low volatile matter pulverized coal are blown through the lance, and white circle is a case that the high volatile matter pulverized coal, the low volatile matter pulverized coal and oxygen are blown through the lance.

As seen from this figure, in the simultaneous blowing of the low volatile matter pulverized coal and the high volatile matter pulverized coal, when the front end of the blowing tube for the high volatile matter pulverized coal in the tube bundle-type lance is set to 0~100 mm from the front end of the blowing tube for the low volatile matter pulverized coal at an upstream side, the combustion rate is improved, and when the distance toward the blast side is short of 100 mm, the combustion rate most rises. This is considered due to the fact that when the front end of the blowing tube for the high volatile matter pulverized coal is arranged to the blast side from the front end of the blowing tube for the low volatile matter pulverized coal, the amount of the burning high volatile matter pulverized coal increases prior to the blowing of the low volatile matter pulverized coal and the burning site of the high volatile matter pulverized coal is overlapped with the blowing position of the low volatile matter pulverized coal to enhance the effect of raising the temperature of the low volatile matter pulverized coal. If the front end of the blowing tube for the high volatile matter pulverized coal is located at the blast side exceeding 100 mm, the combustion rate lowers, which is considered due to the fact that when the front end position is near to the blast side over 100 mm, the combustion of the high volatile matter pulverized coal is ended prior to the blowing of the low volatile matter pulverized coal and heat generated by the combustion is moved into the blast.

In the simultaneous blowing of the low volatile matter pulverized coal, high volatile matter pulverized coal and oxygen, when the front end of the high volatile matter pulverized coal in the tube bundle-type lance is set to 0~200 mm from the front end of the blowing tube for the low volatile matter pulverized coal at an upstream side, the combustion rate is improved, and when the distance toward the blast side is 100 mm, the combustion rate most rises. This is considered due to the fact that when the front end of the blowing tube for the high volatile matter pulverized coal is arranged to the blast side from the front end of the blowing tube for the low volatile matter pulverized coal, the amount of the burning high volatile matter pulverized coal prior to the blowing of the low volatile matter pulverized coal and the amount of oxygen consumed in hot air are increased and the burning site of the high volatile matter pulverized coal is overlapped with the blowing position of the low volatile matter pulverized coal to enhance the effect of raising the temperature of the low volatile matter pulverized coal, while the consumption of oxygen blown from the oxygen blowing tube by the burning of the high volatile matter pulverized coal is suppressed to enhance the improvement of mixing property between the low volatile matter pulverized coal and oxygen.

Figure 21:
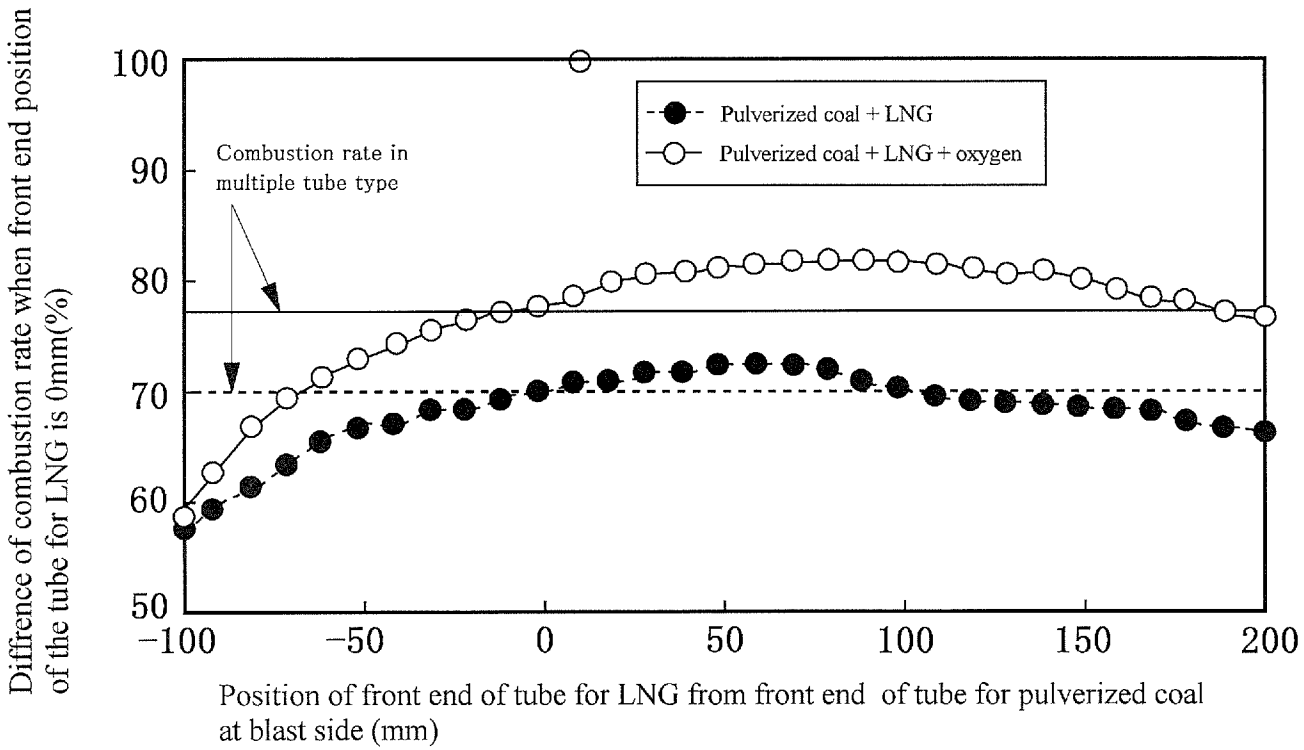
FIG. 21 is a graph showing an influence of a blowing material upon combustion rate in results of combustion test (simultaneous blowing of pulverized coal, LNG and oxygen).

Although the results of combustion rate shown in FIG. 20 correspond to an example of simultaneously blowing the high volatile matter pulverized coal and the low volatile matter pulverized coal, the similar tendency appears, for example, in the blowing of LNG shown in FIG. 21. That is, there is the same tendency when a horizontal axis of FIG. 21 is a front end position (mm) of the blowing tube for LNG or the second tube 22 from the front end of the blowing tube for the pulverized coal or the first tube 21 at the upstream side and a vertical axis thereof is a combustion rate in case that the front end of the LNG blowing tube or the second tube 22 is the same position as the front end of the pulverized coal blowing tube or the first tube 21 (0 mm). Moreover, black circle in FIG. 21 shows a case that both of LNG and pulverized coal are blown through the lance, and white circle shows a case that LNG, pulverized coal and oxygen are blown through the lance.

In the simultaneous blowing of the pulverized coal and LNG, when the front end of the LNG blowing tube is set to 0~100 mm from the front end of the blowing tube for the pulverized coal in the tube bundle-type lance at the upstream side, the combustion rate is improved, and when the distance toward the blast side is short of 100 mm, the combustion rate most rises. This is considered due to the fact that when the front end of the LNG blowing tube is arranged to the blast side from the front end of the pulverized coal blowing tube, the amount of the burning LNG increases prior to the blowing of the pulverized coal and the burning site of LNG is overlapped with the blowing position of the pulverized coal to enhance the effect of raising the temperature of the pulverized coal. If the front end of the LNG blowing tube is located at the blast side exceeding 100 mm, the combustion rate lowers, which is considered due to the fact that when the front end position is near to the blast side over 100 mm, the combustion of LNG is ended prior to the blowing of the pulverized coal and heat generated by the combustion is moved into the blast.

In the simultaneous blowing of the pulverized coal, LNG and oxygen, when the front end of the LNG blowing tube in the tube bundle-type lance is set to 0~200 mm from the front end of the pulverized coal blowing tube at an upstream side, the combustion rate is improved, and when the distance toward the blast side is 100 mm, the combustion rate most rises. This is considered due to the fact that when the front end of the LNG blowing tube is arranged to the blast side from the front end of the pulverized coal blowing tube, the amount of the burning LNG prior to the blowing of the pulverized coal and the amount of oxygen consumed in hot air are increased and the burning site of LNG is overlapped with the blowing position of the pulverized coal to enhance the effect of raising the temperature of the pulverized coal, while the consumption of oxygen blown from the oxygen blowing tube by the burning of LNG is suppressed to enhance the improvement of mixing property between the pulverized coal and oxygen.

DESCRIPTION OF REFERENCE SYMBOLS

1 blast furnace, 2 blast pipe, 3 tuyere, 4 lance, 5 raceway, 6 pulverized coal (solid reducing material), 7 coke, 8 char, 9 LNG (gaseous reducing material), 21 first tube, 22 second tube, 23 third tube

The invention claimed is:

1. A method of operating a blast furnace, the method comprising:

blowing at least a solid reducing material into an inside of the furnace from a lance via a tuyere that is located downstream from the lance, wherein the lance includes a plurality of blowing tubes bundled side-by-side and housed in a main tube of the lance, wherein the lance is used when only the solid reducing material or two kinds of the solid reducing material and a combustible gas or three kinds of the solid reducing material, the combustible gas and a gaseous reducing material are blown in the inside of the furnace, and wherein the solid reducing material, the combustible gas and the gaseous reducing material are blown through respective blowing tubes of the plurality of blowing tubes.

2. The method of operating the blast furnace according to claim 1, wherein the solid reducing material is either a high volatile matter pulverized coal or a low volatile matter pulverized coal or both.

3. The method of operating the blast furnace according to claim 2, wherein a front end of the blowing tube for the high volatile matter pulverized coal is located at a distance of 0~100 mm at an upstream side from a front end of the blowing tube for the low volatile matter pulverized coal when the high volatile matter pulverized coal and the low volatile matter pulverized coal are blown as the solid reducing material.

4. The method of operating the blast furnace according to claim 2, wherein a front end of the blowing tube for the high volatile matter pulverized coal is located at a distance of 0~200 mm at an upstream side from a front end of the blowing tube for the low volatile matter pulverized coal when the high volatile matter pulverized coal, the low volatile matter pulverized coal and oxygen are blown simultaneously.

5. The method of operating the blast furnace according to claim 1, wherein a front end of the blowing tube for the gaseous reducing material is located at a distance of 1~100 mm at an upstream side from a front end of the blowing tube for the solid reducing material when the gaseous reducing material and the solid reducing material are blown simultaneously.

6. The method of operating the blast furnace according to claim 1, wherein a front end of the blowing tube for the gaseous reducing material is located at a distance of 1~200 mm at an upstream side from a front end of the blowing tube for the solid reducing material when the gaseous reducing material, the solid reducing material and oxygen are blown simultaneously.

7. The method of operating the blast furnace according to claim 1, wherein a tube bundle lance formed by winding another blowing tubes around the blowing tube for the solid reducing material and integrally uniting them is used when the solid reducing material, the combustible gas and the gaseous reducing material are blown simultaneously.

8. A lance for blowing at least one of a solid reducing material, a combustible gas and a gaseous reducing material into an inside of a blast furnace via a tuyere located downstream from the lance, the lance comprising:

a main tube; and a plurality of blowing tubes that are bundled at a side-by-side state and housed in the main tube.

9. The lance according to claim 8, wherein the lance is configured to blow the solid reducing material that is either a high volatile matter pulverized coal or a low volatile matter pulverized coal or both.

10. The lance according to claim 9, wherein a front end of the blowing tube for the high volatile matter pulverized coal is located at a distance of 0~100 mm in an upstream side from a front end of the blowing tube for the low volatile matter pulverized coal in the lance blowing the high volatile matter pulverized coal and the low volatile matter pulverized coal as the solid reducing material.

11. The lance according to claim 9, wherein a front end of the blowing tube for the high volatile matter pulverized coal is located at a distance of 0~200 mm in an upstream side from a front end of the blowing tube for the low volatile matter pulverized coal in the lance simultaneously blowing the high volatile matter pulverized coal, the low volatile matter pulverized coal and oxygen as the solid reducing material.

12. The lance according to claim 8, wherein a front end of the blowing tube for the gaseous reducing material is located at a distance of 0~100 mm in an upstream side from a front end of the blowing tube for the solid reducing material in the lance simultaneously blowing the gaseous reducing material and the solid reducing material.

13. The lance according to claim 8, wherein a front end of the blowing tube for the gaseous reducing material is located at a distance of 0~200 mm in an upstream side from a front end of the blowing tube for the solid reducing material in the lance simultaneously blowing the gaseous reducing material, the solid reducing material and oxygen.

14. The lance according to claim 8, wherein the blowing tubes have an inner diameter of not less than 6 mm but not more than 30 mm.

15. The lance according to claim 8, wherein the blowing tubes have an apical structure that a blowing stream of the combustible gas comes into collision with a blowing stream of the solid reducing material.

16. The lance according to claim 8, wherein a blowing tube of the plurality of blowing tubes for the combustible gas is provided at a front end part with a diameter-reducing portion.

17. The lance according to claim 16, wherein the diameter-reducing portion has a diameter such that blowing tube is configured to have a blowing rate of the combustible gas that is 20~200 m/s.

18. The lance according to claim 8, wherein the blowing tubes have a structure that a front end is cut obliquely or a front end is bent.

19. The lance according to claim 8, wherein the lance simultaneously blowing the solid reducing material, the combustible gas and the gaseous reducing material is made by winding another blowing tubes around the blowing tube for the solid reducing material and integrally uniting them.

* * * * *